US011767649B1

(12) United States Patent
Hughes, Jr. et al.

(10) Patent No.: US 11,767,649 B1
(45) Date of Patent: Sep. 26, 2023

(54) FLEXIBLE TRAFFIC CONTROL MARKER

(71) Applicant: FLEXSTAKE, INC., Fort Myers, FL (US)

(72) Inventors: Robert K Hughes, Jr., Cape Coral, FL (US); Marcos Omar Barbian, Fort Myers, FL (US); Agacinki Stanly Titus, Fort Myers, FL (US)

(73) Assignee: FLEXSTAKE, INC., Fort Myers, FL (US)

( * ) Notice: Subject to any disclaimer, the term of this patent is extended or adjusted under 35 U.S.C. 154(b) by 363 days.

(21) Appl. No.: 17/152,771

(22) Filed: Jan. 19, 2021

Related U.S. Application Data

(60) Provisional application No. 62/962,342, filed on Jan. 17, 2020.

(51) Int. Cl.
*E01F 9/623* (2016.01)
*E01F 9/588* (2016.01)
*E01F 9/654* (2016.01)

(52) U.S. Cl.
CPC ..... *E01F 9/588* (2016.02); *E01F 9/654* (2016.02)

(58) Field of Classification Search
CPC ... E01F 9/60; E01F 9/623; E01F 9/627; E01F 9/658; E01F 9/675; E01F 9/681
USPC ..... 404/10
See application file for complete search history.

(56) References Cited

U.S. PATENT DOCUMENTS

| | | | | |
|---|---|---|---|---|
| 4,004,545 | A | 1/1977 | O'Donnell | |
| 4,596,489 | A * | 6/1986 | Mariol | E01F 9/642 404/9 |
| 5,104,256 | A | 4/1992 | D'Avela | |
| 5,197,819 | A | 3/1993 | Hughes | |
| 5,454,665 | A * | 10/1995 | Hughes, Sr. | A01K 61/70 405/35 |
| 7,553,103 | B2 | 6/2009 | Jameson et al. | |
| 7,819,605 | B2 | 10/2010 | Heald | |
| 7,849,617 | B2 | 12/2010 | Intagliata et al. | |
| 7,955,023 | B2 * | 6/2011 | Sung | E01F 9/644 404/9 |
| 8,734,047 | B2 | 5/2014 | Hughes, Jr. | |
| 11,466,414 | B2 * | 10/2022 | Hughes, Jr. | E01F 9/608 |
| 2001/0045675 | A1 | 11/2001 | Attar | |
| 2010/0254761 | A1 * | 10/2010 | Wheeler, Jr. | E05D 7/0423 404/10 |
| 2013/0174776 | A1 * | 7/2013 | Hughes, Jr. | E01F 9/629 116/63 P |

* cited by examiner

*Primary Examiner* — Gary S Hartmann

(57) ABSTRACT

A traffic control marker having a base with a bottom surface suitable for attachment to a road surface using mechanical fasteners and/or adhesive. A top surface of the base includes rounded edges, and a bottom surface with an inset groove pattern. A flexible outer tube is engaged over an inner tube, where both tubes have a circular cross-sectional configuration. The telescoping tubes are captured within a clamping assembly that is securely and mechanically engaged within a support cavity formed in the base. The base with the support cavity enables enhanced attachment to the road surface, as well as improved drainage through the traffic control marker. The interconnection of the base, tubes and clamping assembly enables the tubes to breakaway from the base after numerous vehicle impacts, and to resist removal of the base from the road surface.

17 Claims, 23 Drawing Sheets

FLEXIBLE TRAFFIC CONTROL MARKER

CROSS-REFERENCE TO RELATED APPLICATIONS

This application claims priority to the benefit of U.S. Patent Application Ser. No. 62/962,342 filed Jan. 17, 2020, the entirety of which is incorporated herein by reference.

FIELD OF INVENTION

The present application relates generally to a traffic control device or marker (collectively, traffic control marker), and more specifically to a traffic control marker having an improved base and clamp assembly enabling a flexible tube or post to flex upon impact, and rebound, leaving the flexible tube secured within the base, and the base secured to the road surface.

BACKGROUND

Traffic control markers used on road surfaces or other marked areas are frequently struck by moving vehicles. These traffic control markers often have an outer tube or post mounted to a base. Typically, the traffic control marker includes a reflective sheeting partially or completely surrounding the primary tube intended to warn or guide a vehicle operator by better illuminating certain spaces, for example, at night or through a construction zone. Non-limiting examples of commonly used traffic control markers include traffic cones and barrels.

Another type of traffic control marker is a flexible delineator marker, often used in a highway environment. Such highway markers typically include a flexible insert positioned in or on a primary tube of the marker to provide it with a rebound effect following an impact. In particular, the insertion of the flexible insert into the primary tube of the highway marker allows the traffic control marker to return to a substantially upright position after being struck and deflected by a moving vehicle. In addition to other attachment methods, a conventional traffic control marker may be attached to the road surface using an epoxy or other adhesive, in addition to optional mechanical fasteners.

A vehicular strike may overcome the adhesive or epoxy seal created between the road surface and the base of the highway marker, causing the highway marker to detach from the road surface at, or near, the base. Examples of an improved base for attachment to the road surface are provided in U.S. Pat. Nos. 5,197,819 and 8,734,047. Further, the primary tube, and thus the reflective sheet or indicia attached thereto, may break, crack off or become detached from the highway marker, and destroyed upon repeated impacts by moving vehicles. It can be costly, dangerous and time consuming to repair or replace damaged base or flexible tube components of traffic control markers.

While many improvements have been provided to address the problem of damaged traffic control markers, it continues to be desirable to provide a further improved traffic control marker, or flexible highway marker, to resist damage after repeated vehicle impacts.

SUMMARY

The present application is directed to an improved traffic control marker having a rectangular base with a bottom surface suitable for attachment to a road surface using mechanical fasteners and/or adhesive. Two embodiments of the traffic control marker are provided. In one embodiment, a rectangular configuration includes a top surface with an elongated front ramp portion formed by 2 opposed longer sides and 2 opposed short front and rear sides. In a second embodiment, a square base with round-edged support ribs is provided.

Additional components of the traffic control marker include a primary tube or outer marker formed by a flexible outer tube engaged over an inner tube, where both tubes have a circular cross-sectional configuration. The telescoping tubes are captured within a clamping assembly that is securely and mechanically engaged with the base. The improved base in the traffic control markers provides enhanced attachment to the road surface, while the clamping assembly enables improved flexibility upon vehicle impact, as well as improved drainage through the traffic control marker. The improved clamping assembly interconnecting the base and tubes enhances the structural integrity of the circular tubes and reduces damage to the traffic control marker upon vehicle impacts, in order to improve the functioning life and repair of traffic control markers following vehicle impacts.

The base of the improved traffic control marker embodiments may be selectively mounted on a road surface, or adjacent a roadway. A support cavity is provided within the base for engagement with the clamping assembly and tubes. An opening into the support cavity on the top surface of the base is provided at a height raised from the perimeter of the base.

The clamping assembly provided is formed by 2 semi-circular clamp members that surround the circular tubes, and are secured together by conventional fasteners through the clamp members. With the circular tubes captured within the semi-circular clamp members of the clamping assembly, the clamping assembly is then secured within the support cavity of the base using a single long pin. The pin is engaged through locking pin holes 28 located below the location where the conventional fasteners are secured through the clamping assembly, as shown in FIG. 29, transverse to a central axis of the circular tubes, and aligned and formed through the clamping assembly and base. Once the tubes are tightly secured within the clamping assembly and base using the conventional fasteners and pin, initial impacts to the traffic control marker enable flexible return of the inner and outer tubes to their upright position. A non-sharp corner, whether a rounded or chamfered top surface on the inner tube, is provided to resist cutting or damage to the outer tube by the inner tube upon vehicle impact.

Additionally, an internal drainage path is provided first through the inner tube, past the pin engaged through the locking pin holes, and out of the base. Such internal drainage removes liquid from inside the inner and outer tubes, at a location below attachment of the tubes and clamping assembly, since drain holes in the outer tube above the attachment location may create fracture points upon vehicle impact.

After numerous vehicle impacts, a critical final vehicle impact to the outer tube may result in the tubes breaking away from the clamping assembly, but without removal, or pulling up, of the base from the roadway. Following a critical vehicle impact, any damaged tubes or components of the clamping assembly may be removed and replaced, potentially without the need to replace or reattachment of the base to the roadway.

DETAILED DESCRIPTION

Figure 1:
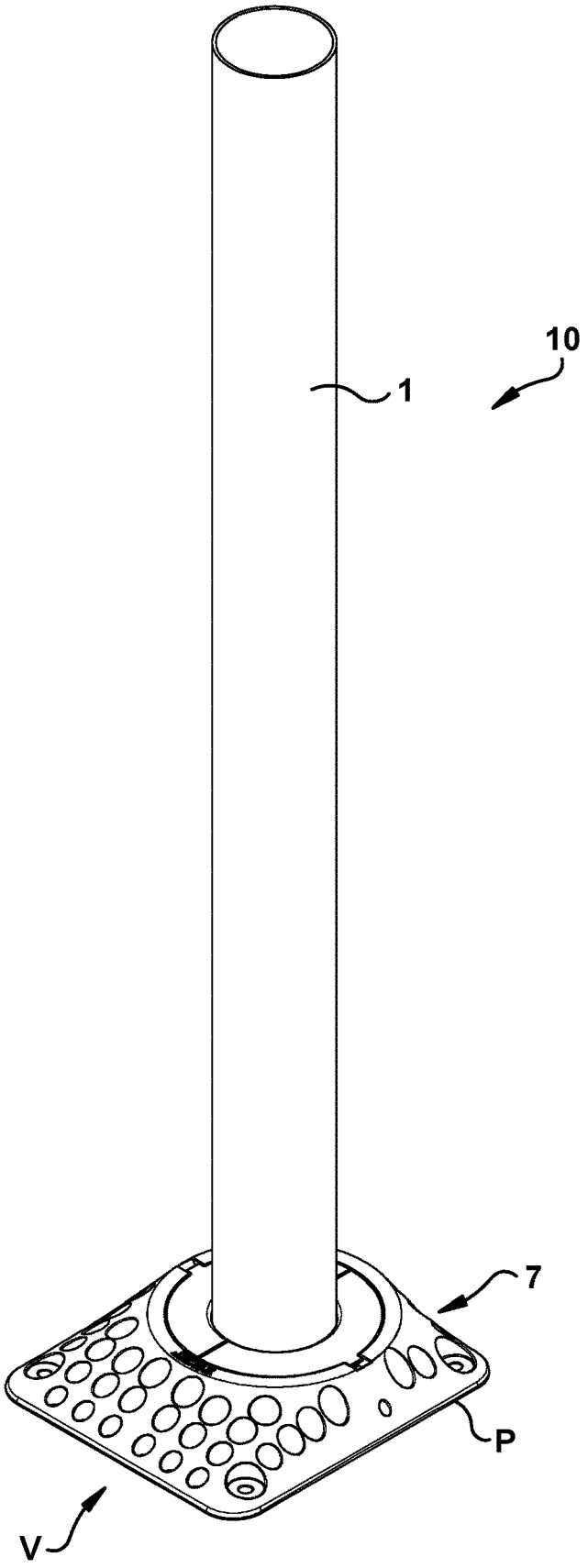
FIG. 1 is a right side perspective view of one embodiment of the traffic control marker of the present application, prior to attachment to a road surface.
Figure 2:
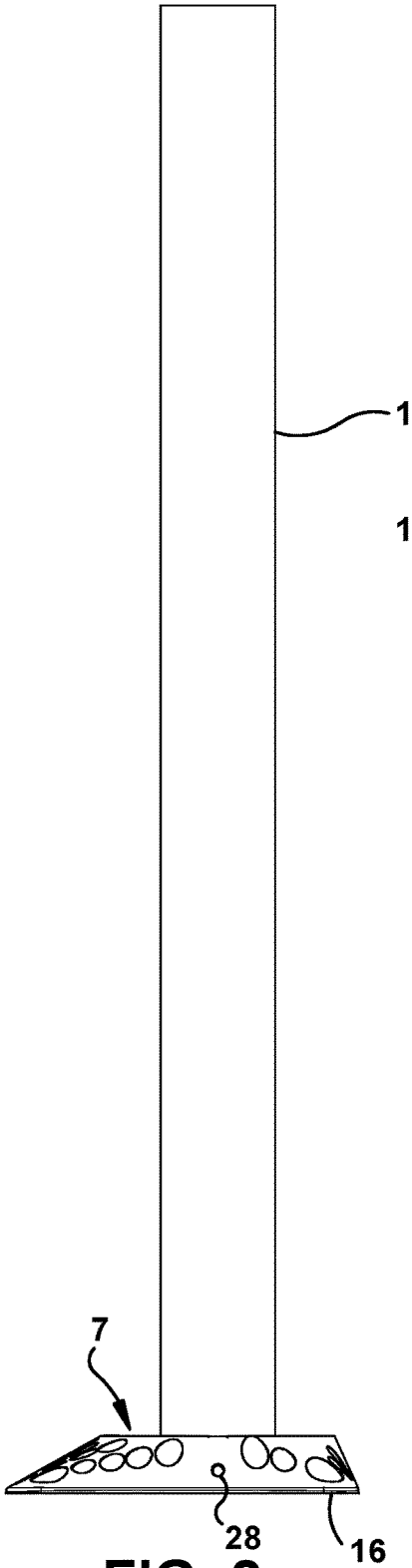
FIG. 2 is a left side plan view of the traffic control marker of FIG. 1.
Figure 3:
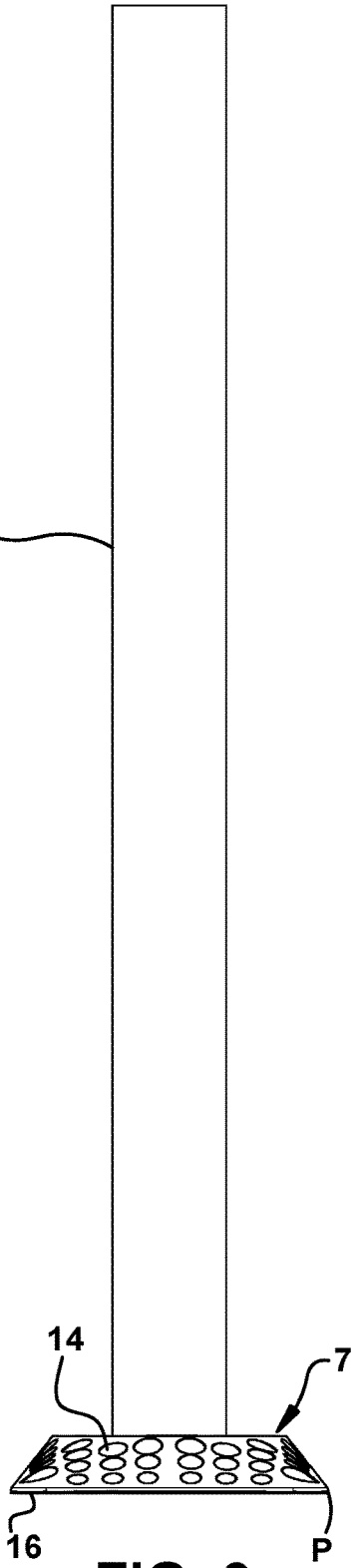
FIG. 3 is a front plan view of the traffic control marker of FIG. 1.
Figure 4:
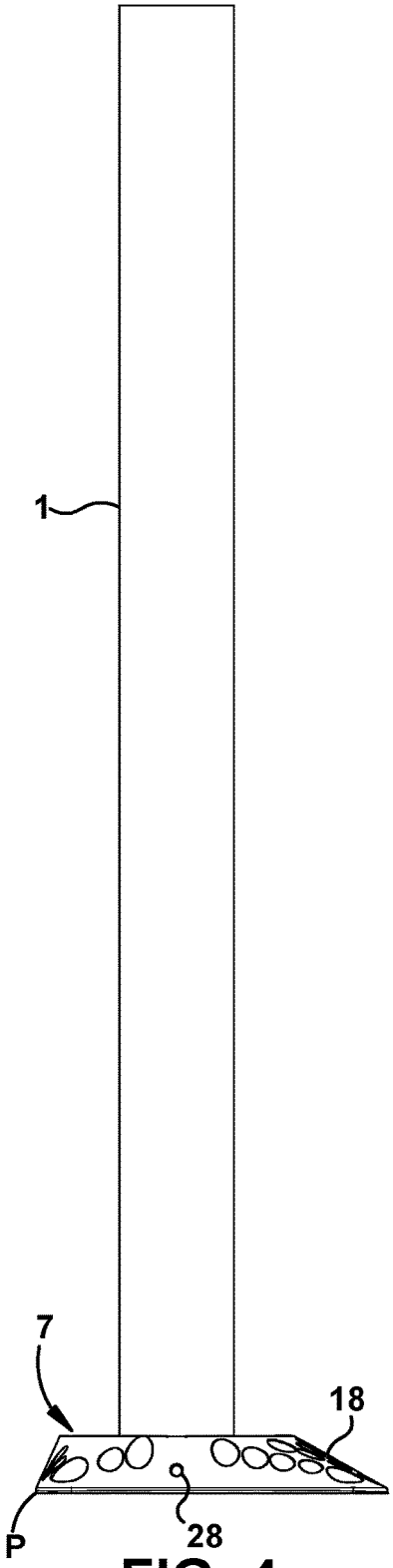
FIG. 4 is a right side plan view of the traffic control marker of FIG. 1.
Figure 5:
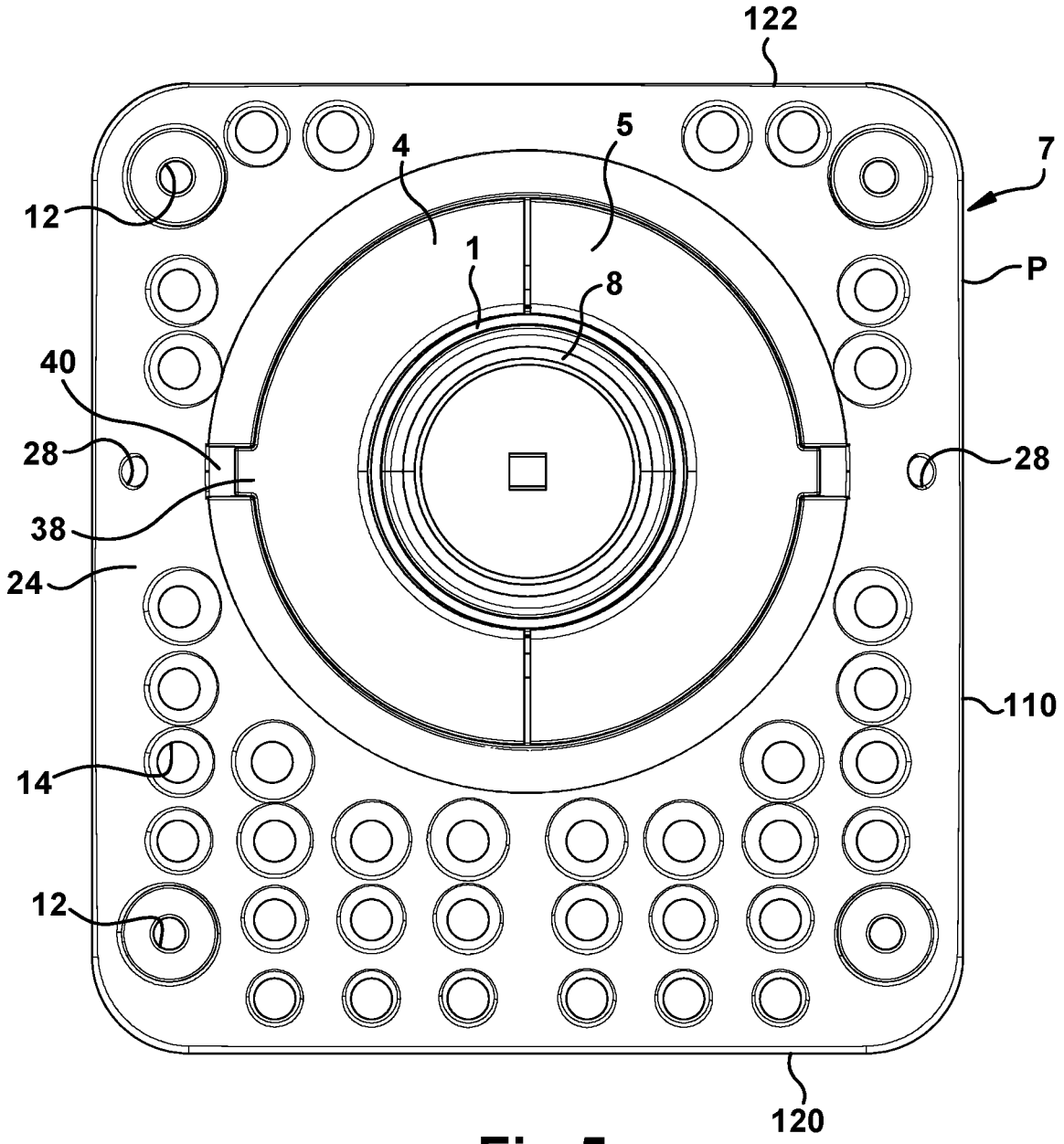
FIG. 5 is a top view of the traffic control marker of FIG. 1.
Figure 6:
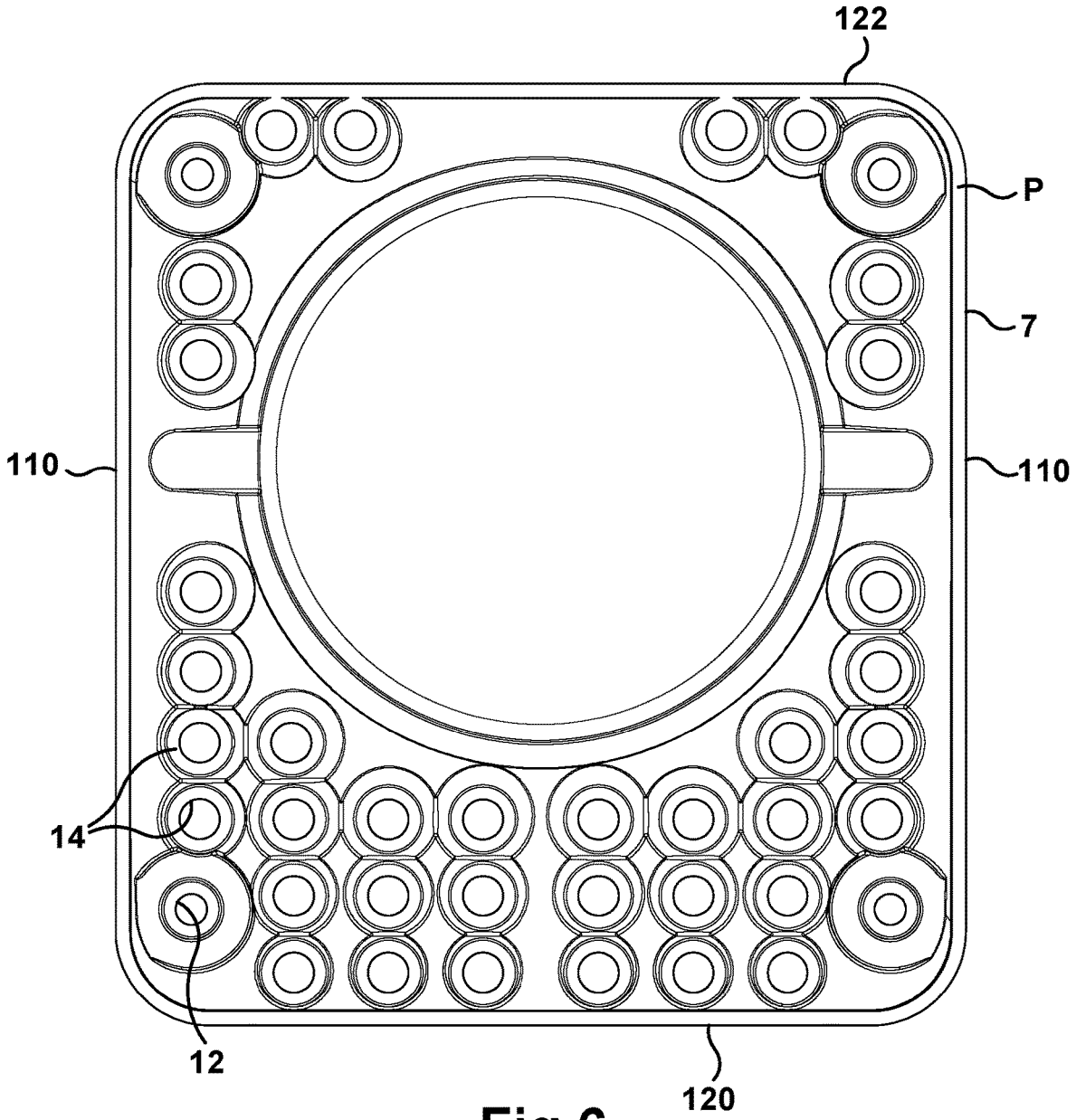
FIG. 6 is a bottom view of the traffic control marker of FIG. 1.
Figure 7:
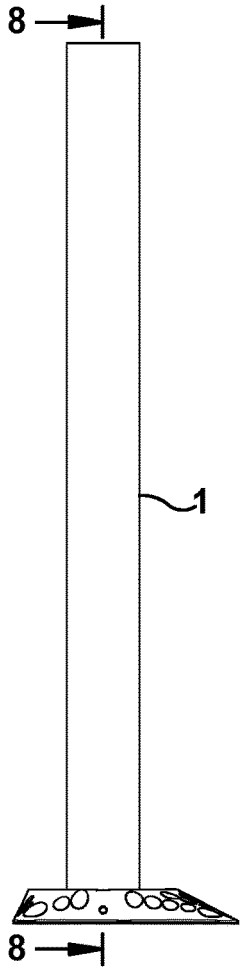
FIG. 7 is a right side plan view as in FIG. 4.

The improved flexible traffic control marker 10, 10' of the present application is shown in detail in one embodiment in FIGS. 1 to 15B, and in a second embodiment in FIGS. 16 to 29B. It should be understood that where aspects of the flexible traffic control marker in each of the embodiments are the same or similar, the components are referenced using the same reference number or with a prime designation. Where the components differ, different reference numbers are used.

The flexible traffic control marker includes a base 7, 7'. The base may have a rectangular or oblong outer perimeter, as in FIGS. 1 to 15B, with 2 long sides 110 (at least 10 to 11 inches) and a front side 120 and a rear side 122 that are shorter than the long sides (approximately 9 inches). Alternatively, the base 7' may have a square perimeter with equal length sides 210 of 8 inches.

Figure 20:
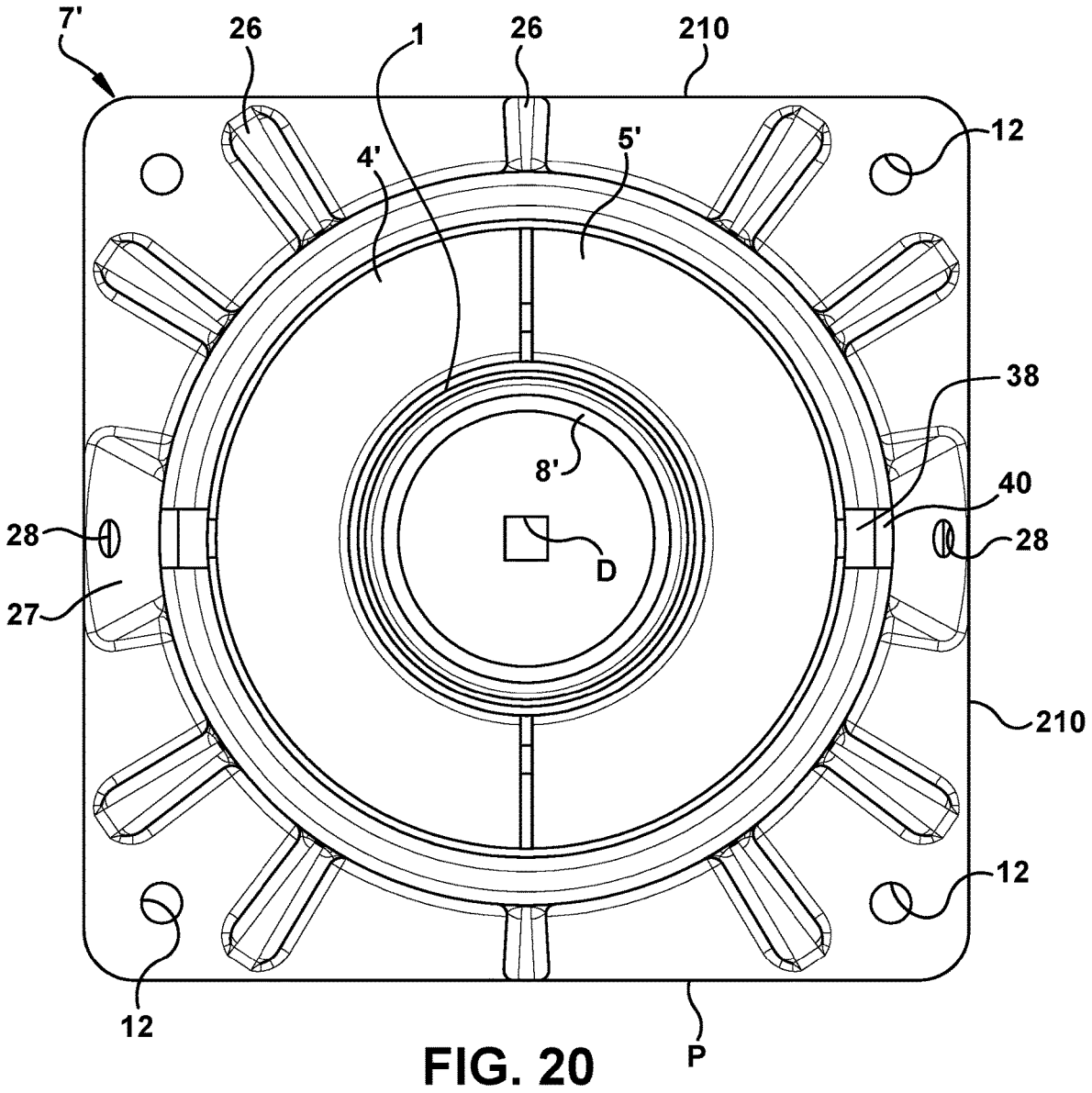
FIG. 20 is a top view of the traffic control marker of FIG. 16.
Figure 21:
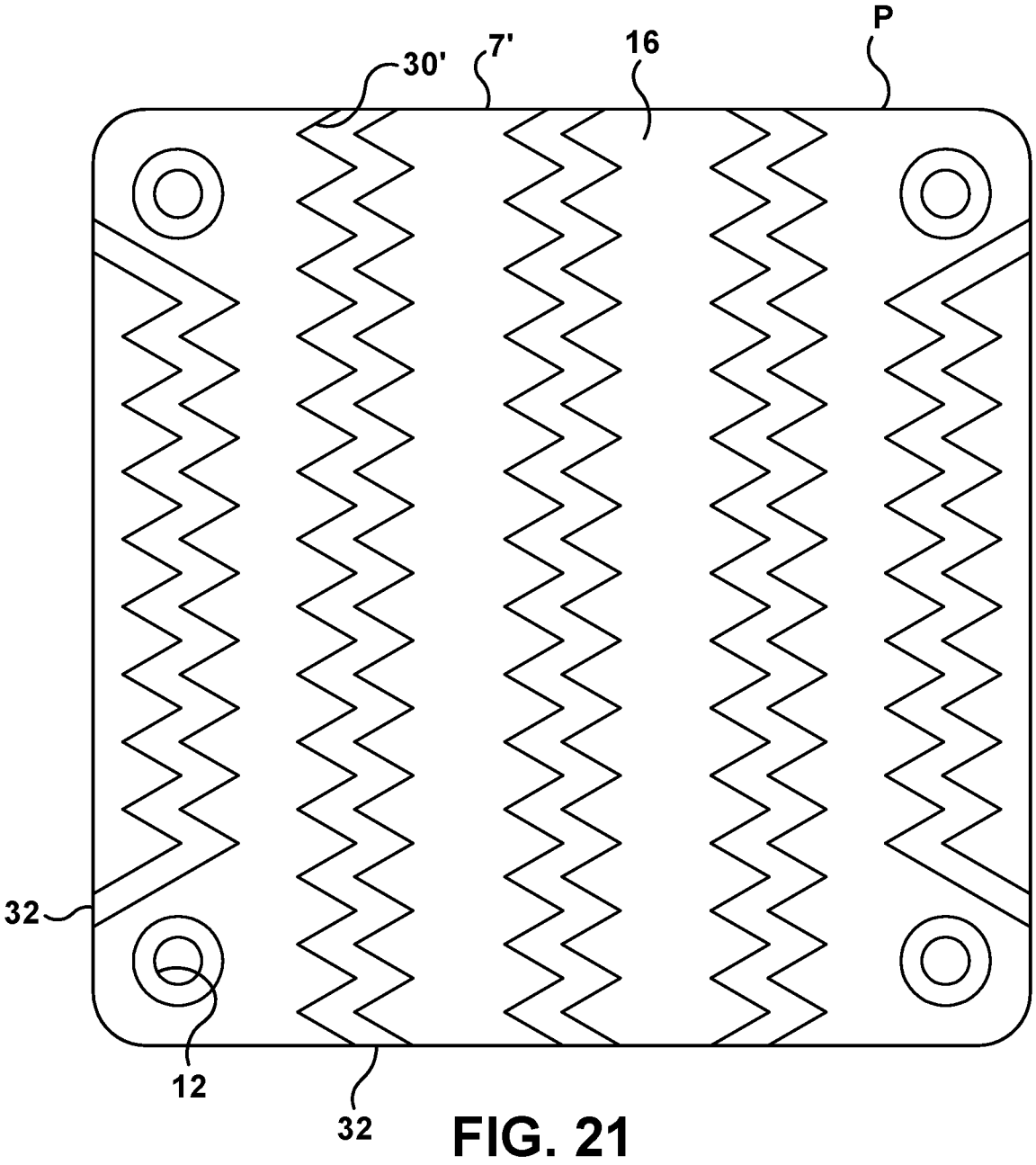
FIG. 21 is a bottom view of the traffic control marker of FIG. 16.

The traffic control marker 10, 10' includes a primary tube or marker formed by a flexible outer tube 1 engaged over a unitary, molded inner tube 8, 8', where both tubes have a circular cross-sectional configuration. As shown in FIGS. 1 to 5, and 16 to 20, the telescoping tubes 1, 8 and 1, 8' each have a central aligned axis A, and the tubes are captured within a clamping assembly 9 that is mechanically engaged and secured within the base. The base 7, 7' may be attached to a roadway via conventional fasteners through corner openings 12 formed through the base. Additionally, epoxy or other appropriate adhesive may alternatively or also be used to secure the base to the roadway surface, and may also be engaged through the corner openings and other adjacent holes 14 formed through the base 7. In the embodiment of FIG. 21, a bottom surface 16' of the base 7' is provided with inset channels 30 formed in a geometric pattern, shown for example, as a zigzag pattern. The inset channels 30 provide a location for epoxy or other appropriate adhesive to reside within the bottom surface 16 for enhanced attachment of the traffic control marker 10 to the road bed. Patterns of any alternate shape may be used, but the ends 32 of each of the inset channels 30 are each open at the perimeter of the base, so that excess adhesive material may freely exit the inset channels 30 during the process of securing the base to the roadway.

Figure 12:
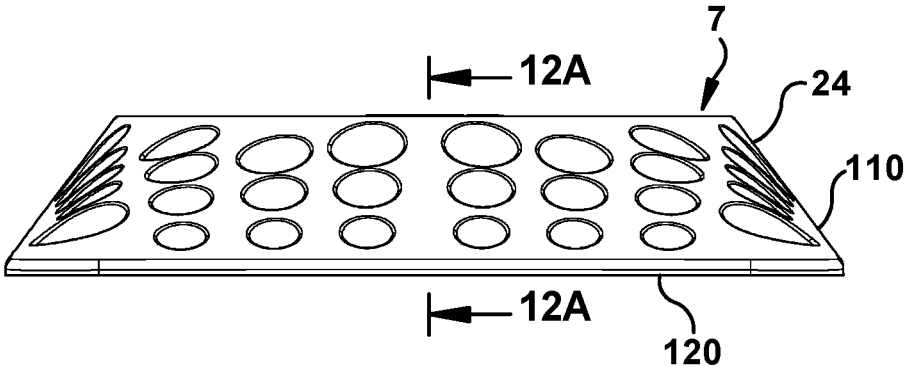
FIG. 12 is a front plan view of the base of the traffic control marker of FIG. 1.
Figure 12A:
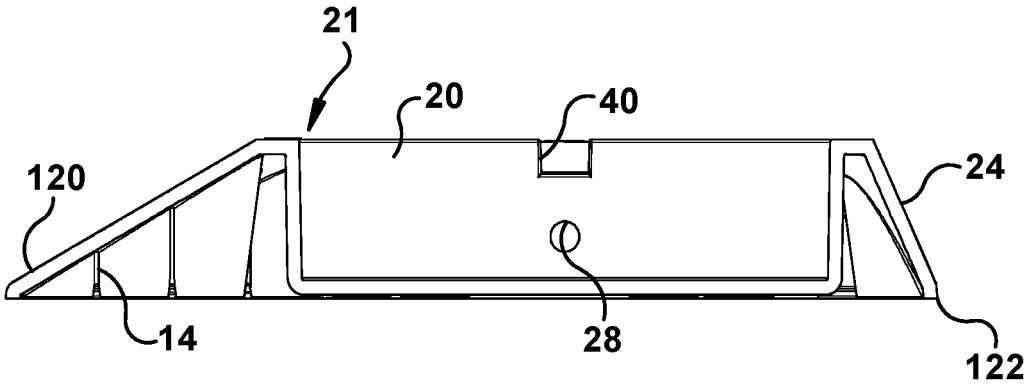
FIG. 12A is a cutaway view showing a cross-section taken along the line 12A-12A of FIG. 12.
Figure 13:
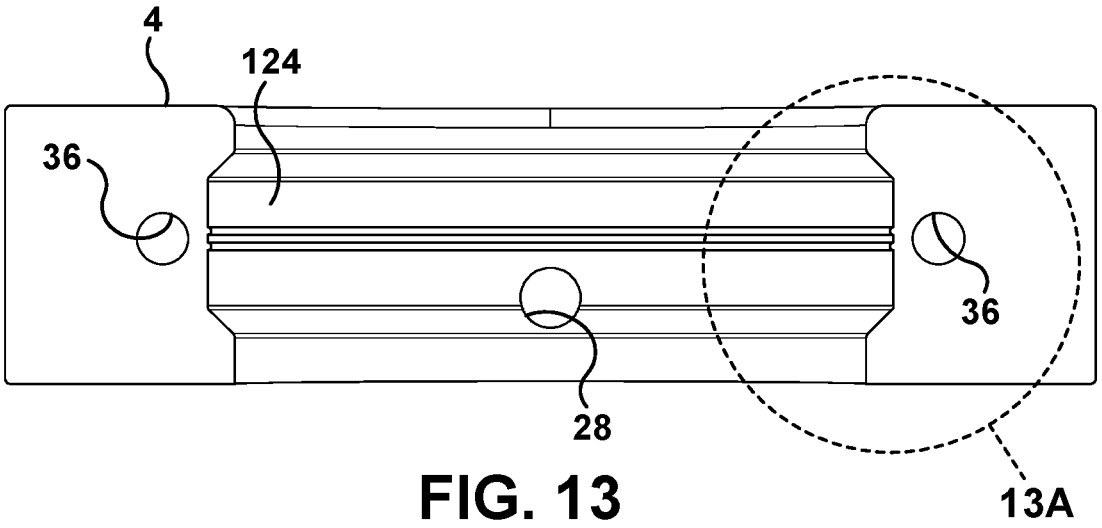
FIG. 13 is a plan view of the left portion of the clamping assembly shown in FIG. 11.
Figure 13A:
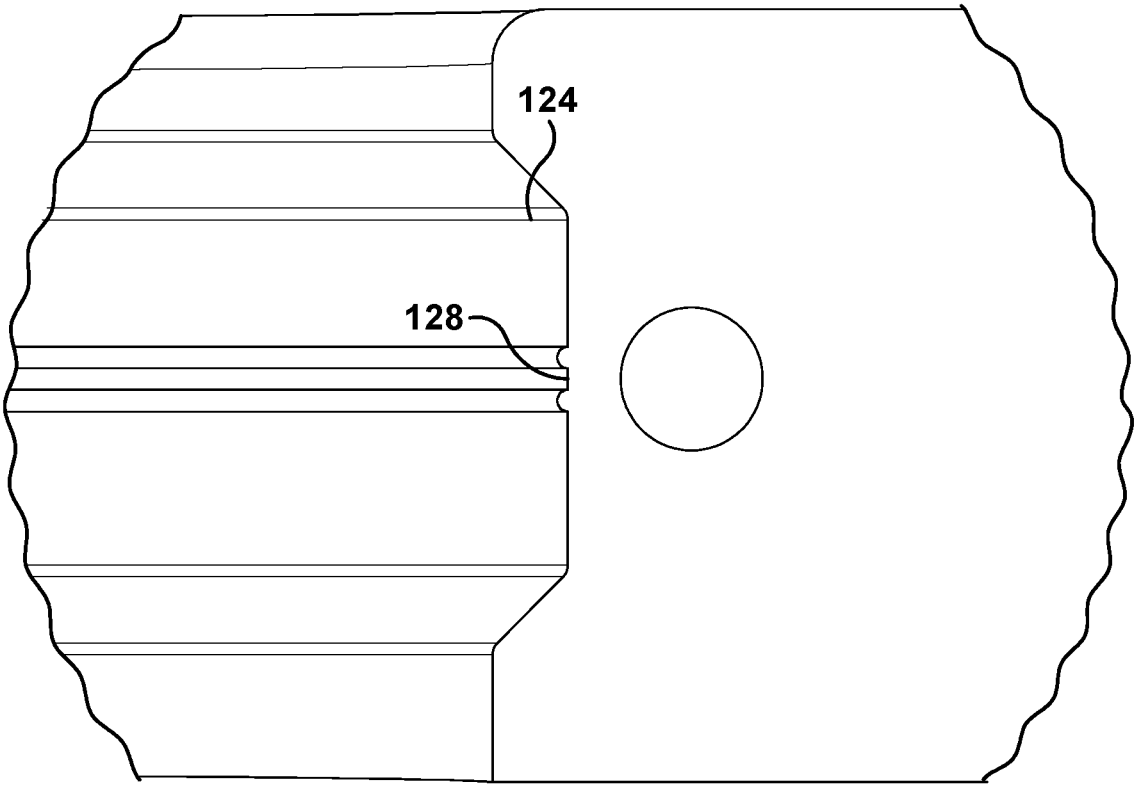
FIG. 13A is a partial enlarged view of the portion of the clamping assembly indicated at reference 13A in FIG. 13.
Figure 14:
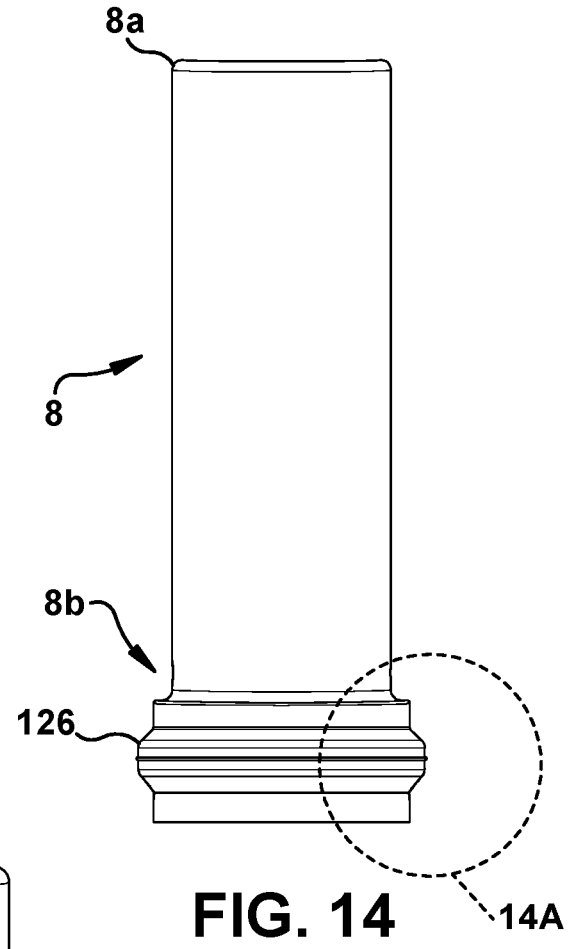
FIG. 14 is front plan view of the inner tube of the traffic control marker of FIG. 9A.
Figure 14A:
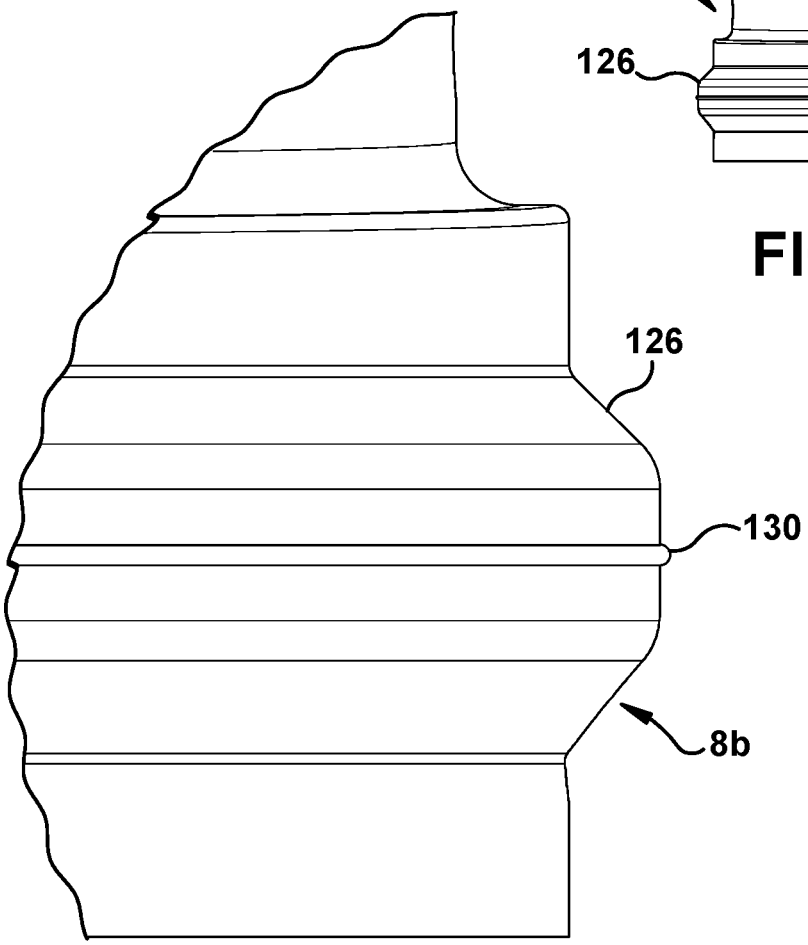
FIG. 14A is a partial enlarged view of the portion of the inner tube indicated at reference 14A in FIG. 14.
Figure 26:
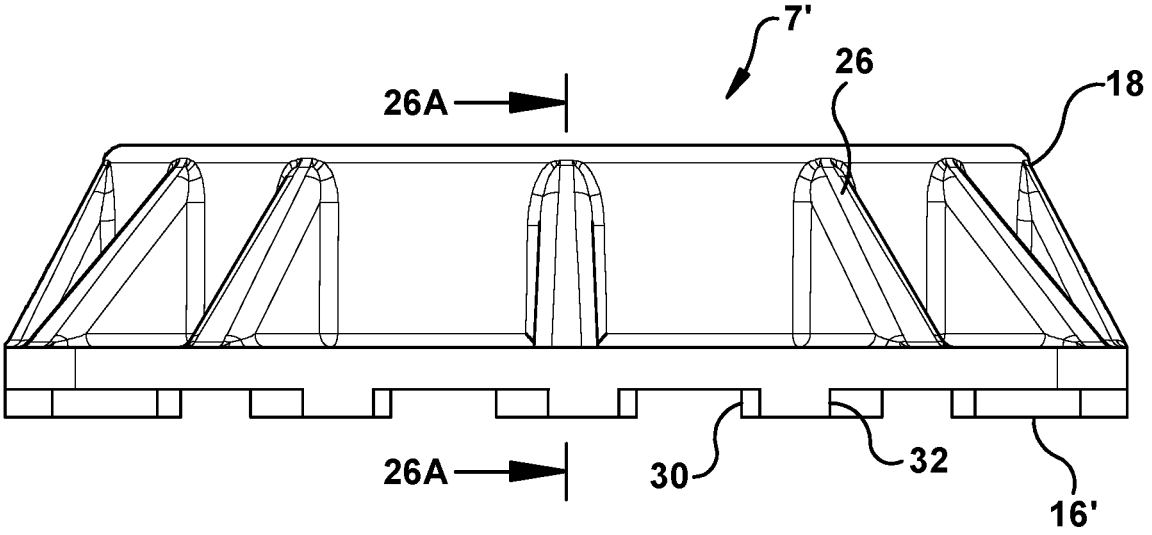
FIG. 26 is a front plan view of the base of the traffic control marker of FIG. 16.
Figure 26A:
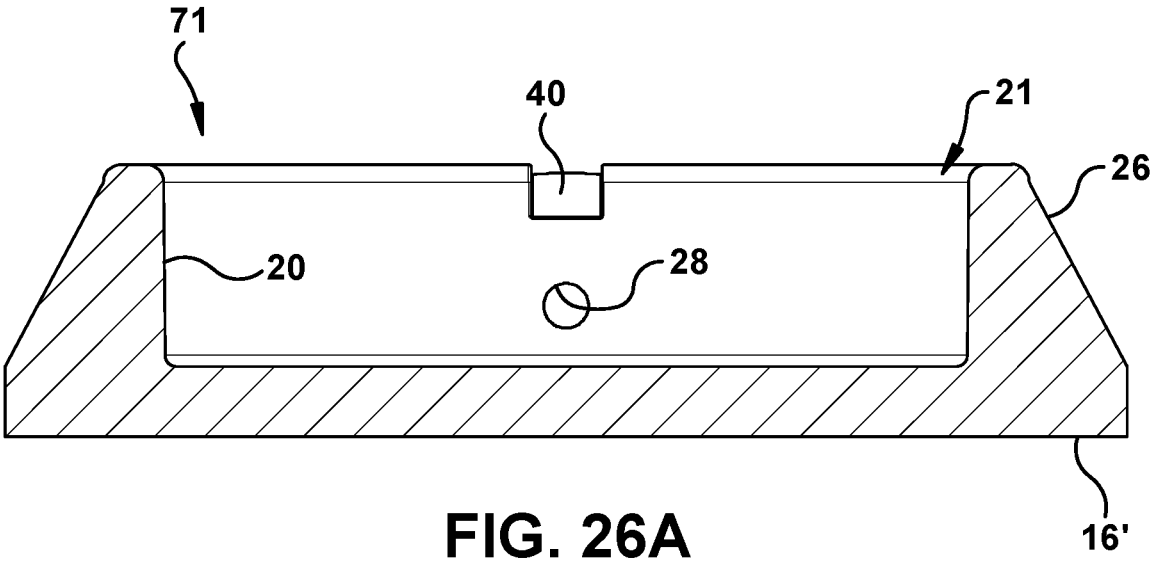
FIG. 26A is a cutaway view showing a cross-section taken along the line 26A-26A of FIG. 26.
Figure 28:
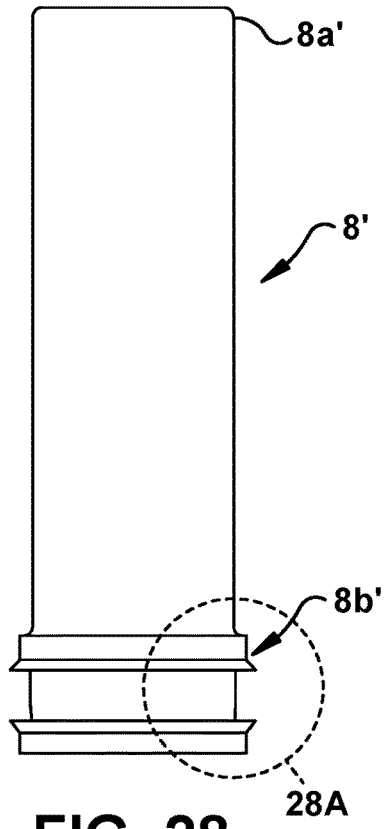
FIG. 28 is front plan view of the inner tube of the traffic control marker of FIG. 23A.
Figure 28A:
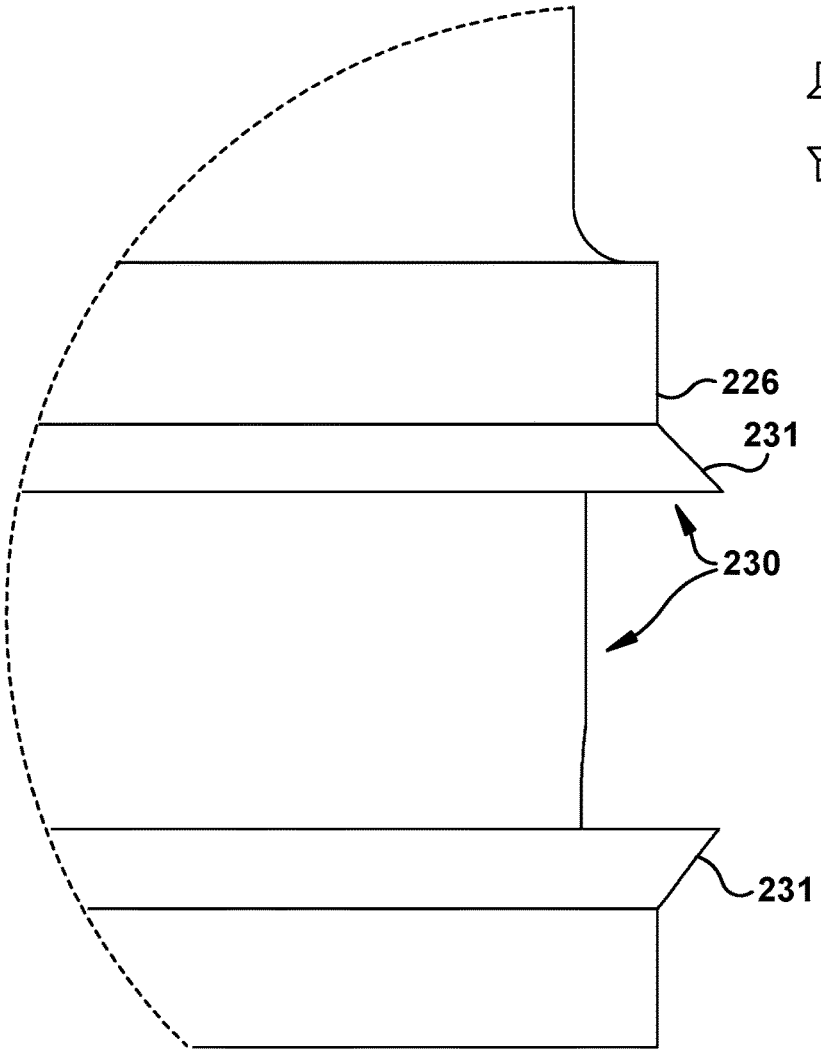
FIG. 28A is a partial enlarged view of the portion inner tube indicated at reference 28A in FIG. 28.

The base 7, 7' has a bottom surface 16 and a top surface 18, with a support cavity 20 having an opening 21 formed in the top surface 18. In the embodiment of FIGS. 1 to 15B, the support cavity 20 is located at a position equally spaced from the rear side 122 and two long sides 110. In the embodiment of FIGS. 16 to 29B, the support cavity 20 is centrally located within the base 7'. The support cavity 20 provided in the base 7, 7' is for engagement by the clamping assembly and tubes, as shown in FIGS. 1 to 8A and FIGS. 16 to 22B. As shown in FIGS. 12A and 26A, the support cavity opening 21 on the top surface 18 of the base is provided at a height raised from the perimeter P of the base 7, 7'.

In the embodiment of FIGS. 1 to 15B, the front side 120 of the base 7 forms a gradual ramp up the top surface of the base to the offset support cavity opening 21, while the 3 remaining sides 110, 122 form steeper ramps or side walls 24 from the perimeter P of the base to the support cavity opening. The traffic control marker 10 is oriented on the roadway, such that the gradual ramp up the front side 120 of the base is the direction V from which a vehicle would generally approach and impact the base 7 of the traffic control marker 10, as indicated in FIG. 1. The use of an offset support cavity results in more base material being provided at the front side 120 of the base 7, such that the base tends to remain secured to the roadway during a vehicle impact.

Figure 16:
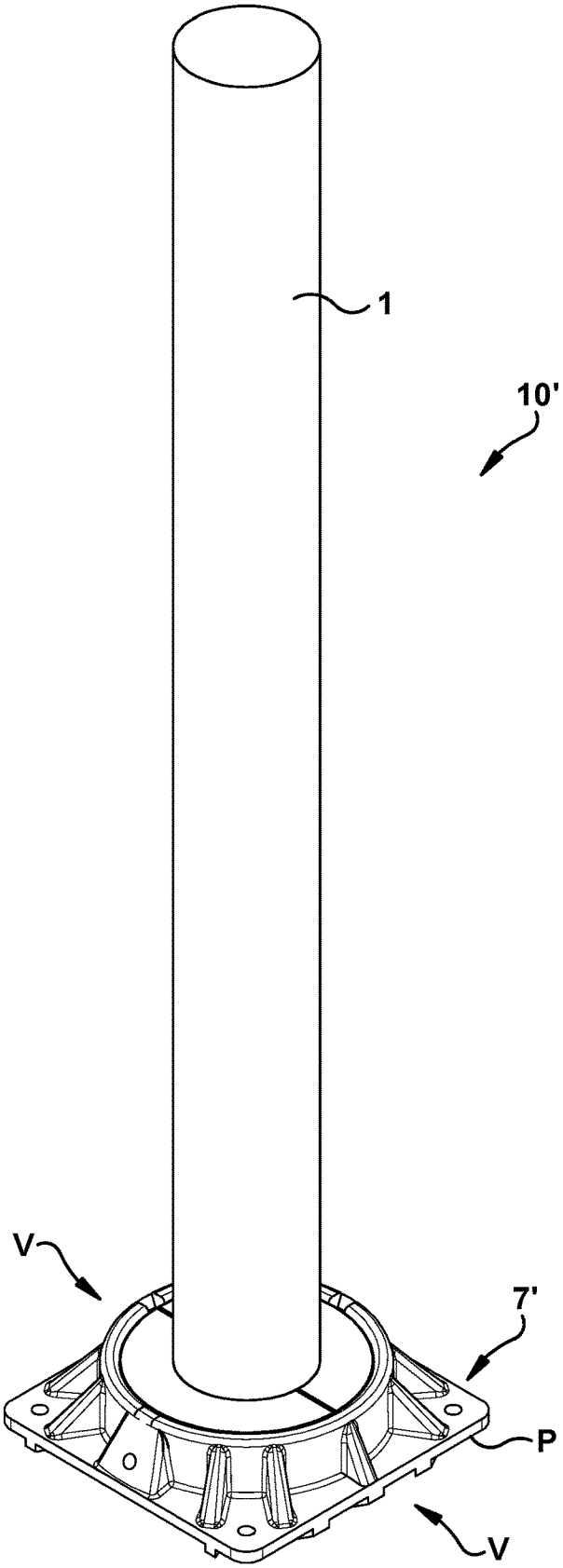
FIG. 16 is a left side perspective view of a second embodiment of the traffic control marker of the present application, prior to attachment to a road surface.
Figure 17:
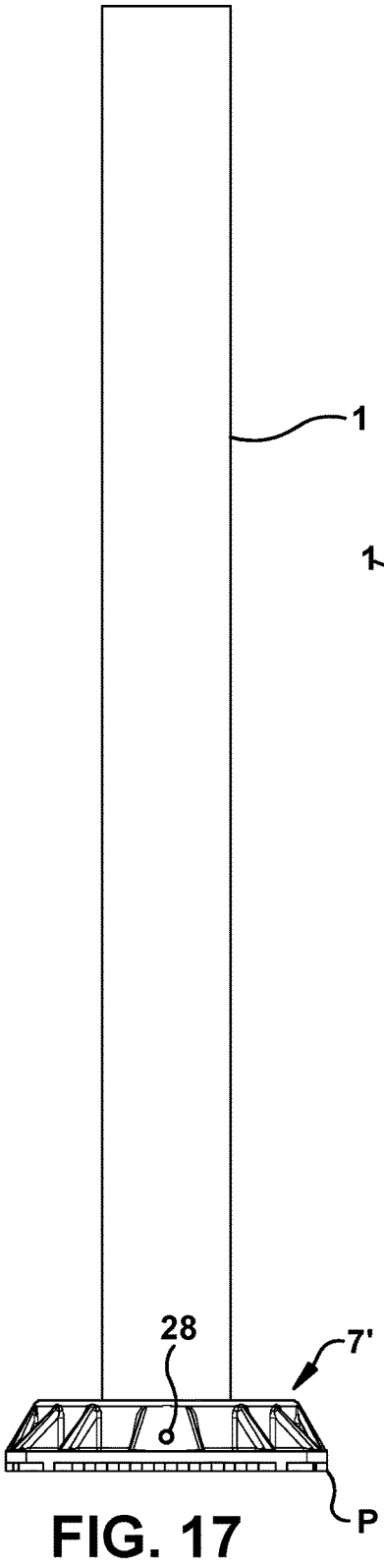
FIG. 17 is a left side plan view of the traffic control marker of FIG. 16.
Figure 18:
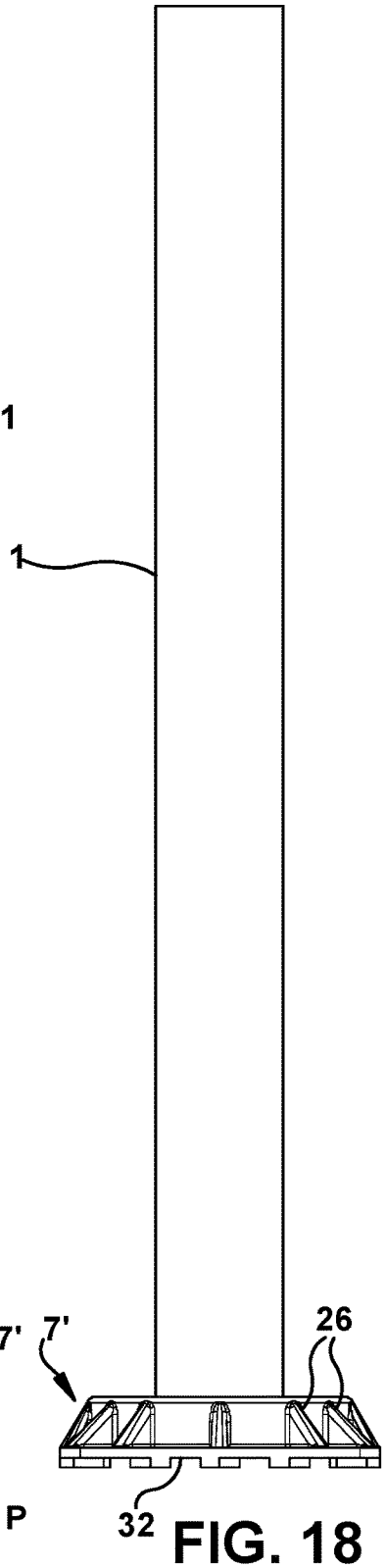
FIG. 18 is a front plan view of the traffic control marker of FIG. 16.
Figure 19:
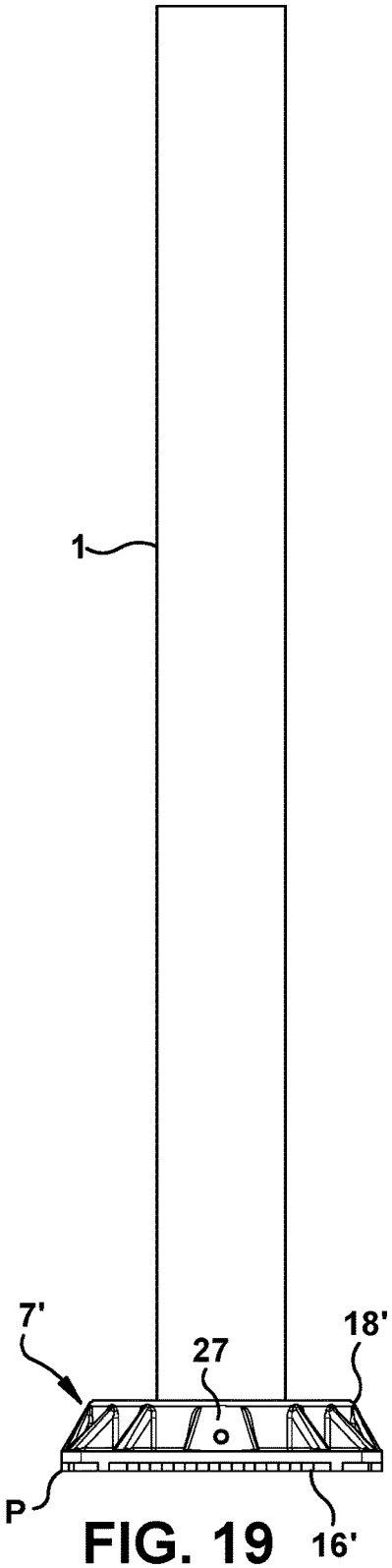
FIG. 19 is a right side plan view of the traffic control marker of FIG. 16.

In the embodiment of FIGS. 16 to 29B, the base 7' is provided with molded support ribs 26 supporting the centered support cavity 20 and opening 21 within the base. The support ribs 26 are spaced surrounding the support cavity 20 and the support cavity opening 21. Two reinforced support ribs 27 are provided on either side of the base 7' at the location where a locking pin 2 is engaged through the reinforced support ribs on the base, the clamping assembly and the tubes. It is noted that there are no right angles or sharp corners or sharp edges on any exposed surface of the base 7, 7' when in use, including the top surface 18 and all surfaces of the support ribs 26, 27, which are all provided with edges having a radius and not right angle corners, as shown in FIG. 20, for example. In this second embodiment of the traffic control marker, the base is preferably oriented on the roadway, such that the reinforced support ribs 27 are oriented perpendicular to the side of the base from the direction V a vehicle would generally approach and impact the base of the traffic control marker, as indicated in FIG. 16.

Figure 8:
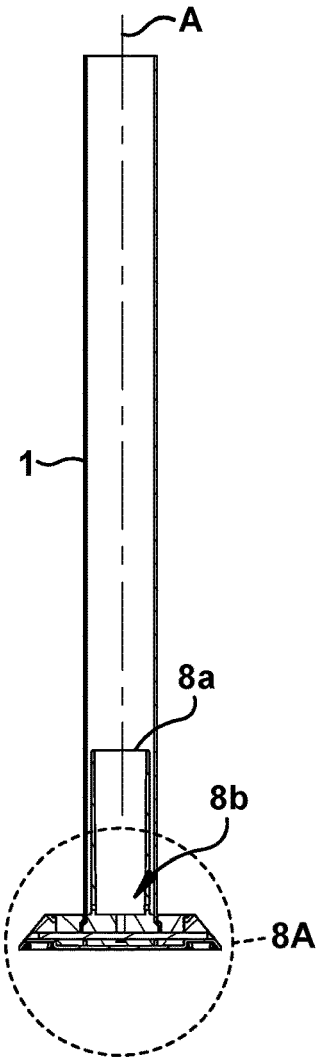
FIG. 8 is a cutaway view showing a cross-section taken along the line 8-8 of FIG. 7.
Figure 8A:
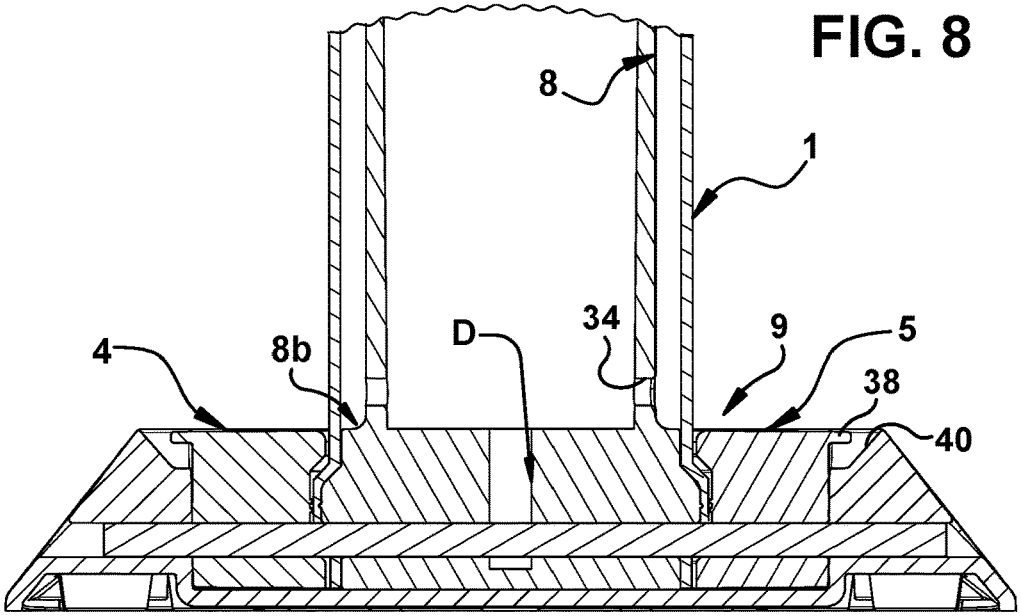
FIG. 8A is a partial enlarged view of the cross-sectional portion indicated at reference 8A in FIG. 8.
Figure 9:
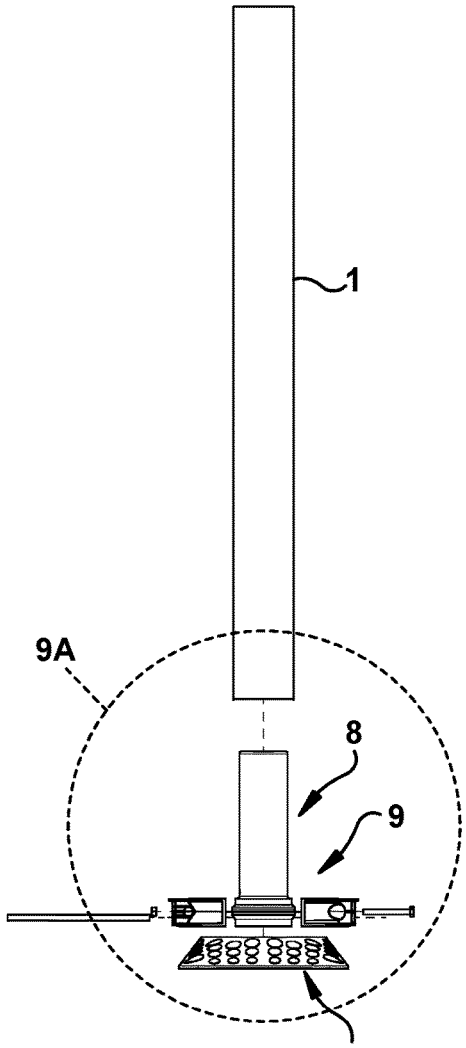
FIG. 9 is a front exploded view of the traffic control marker of FIG. 3.
Figure 9A:
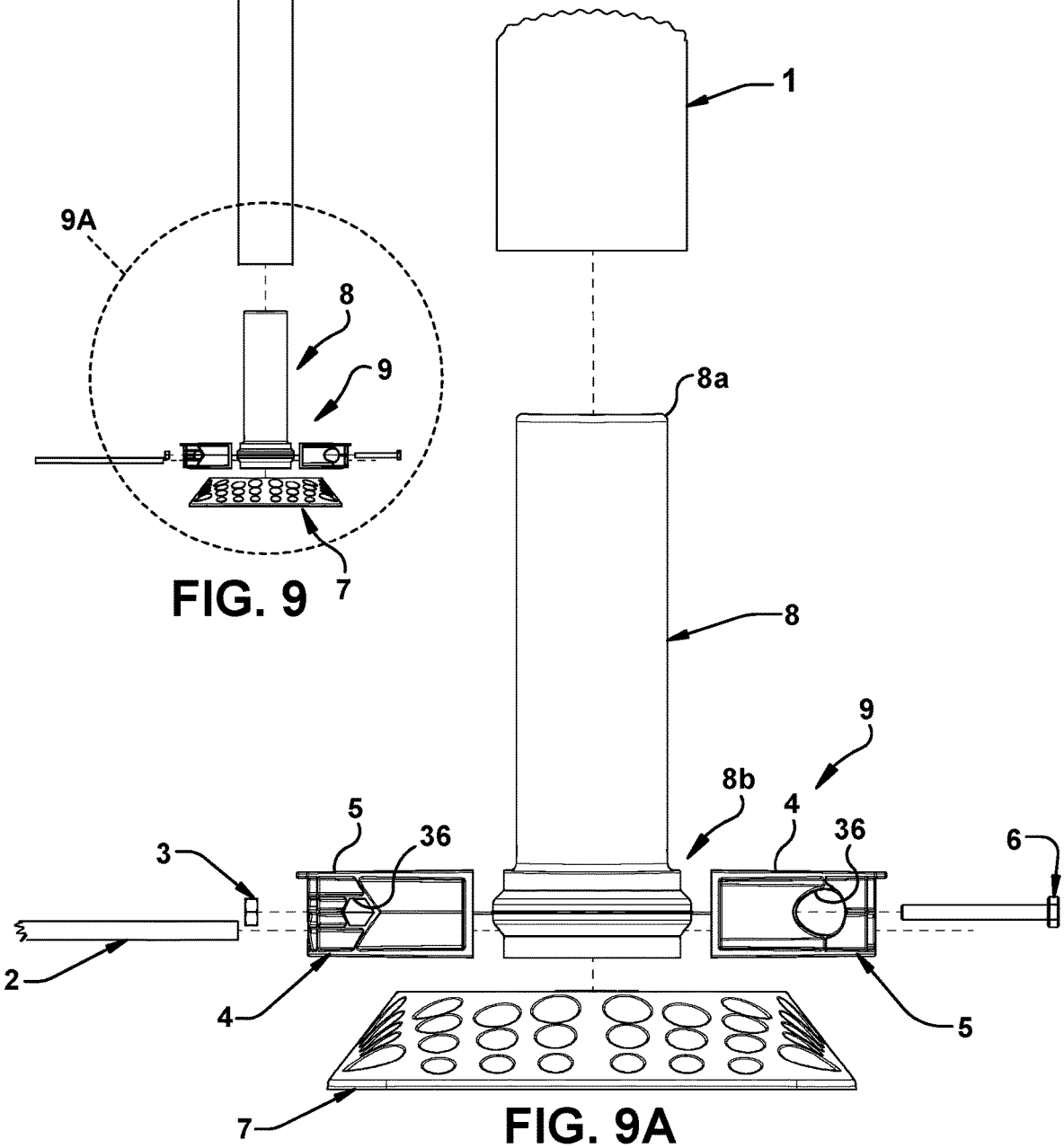
FIG. 9A is a partial enlarged exploded view of the portion indicated at reference 9A in FIG. 9.
Figure 10A:
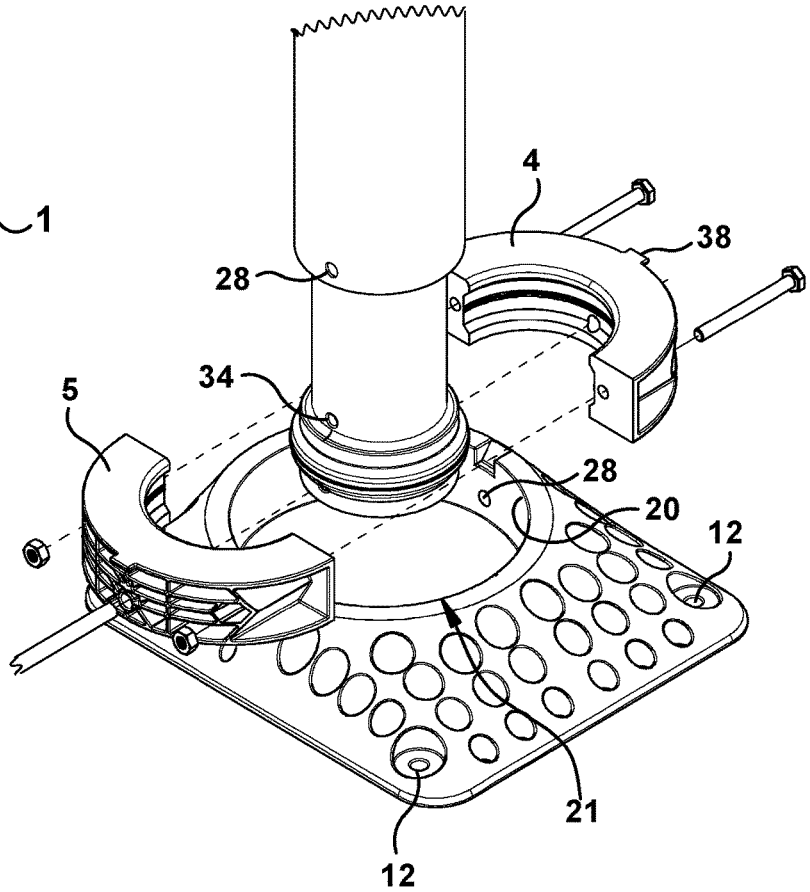
FIG. 10A is a partial enlarged exploded view of the portion indicated at reference 10A in FIG. 10.
Figure 10:
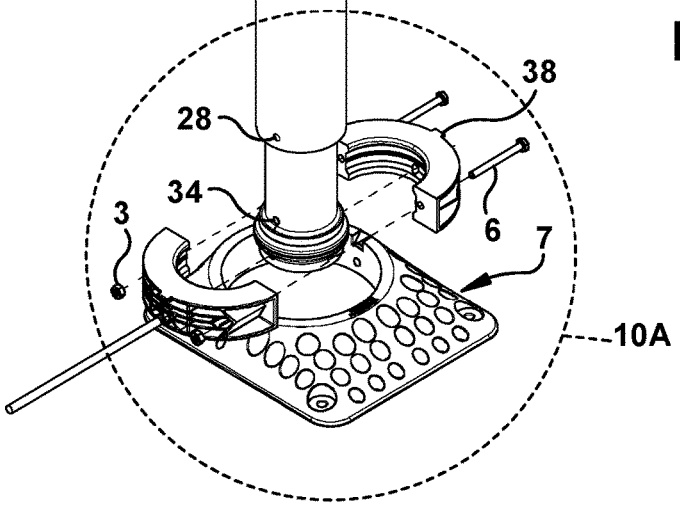
FIG. 10 is a left side perspective exploded view of the traffic control marker of FIG. 1.
Figure 15:
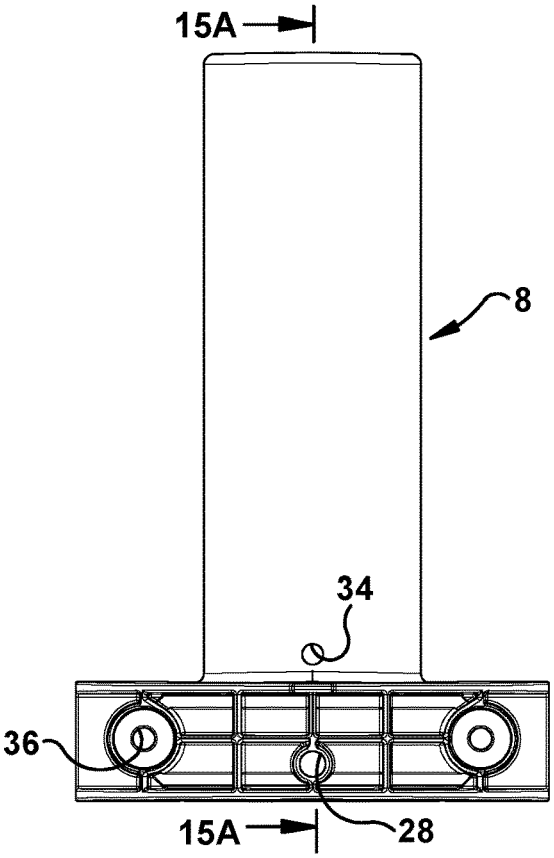
FIG. 15 is a partially assembled side view of the inner tube and clamping assembly components of the traffic control marker, along the lines shown in FIG. 11.
Figure 15A:
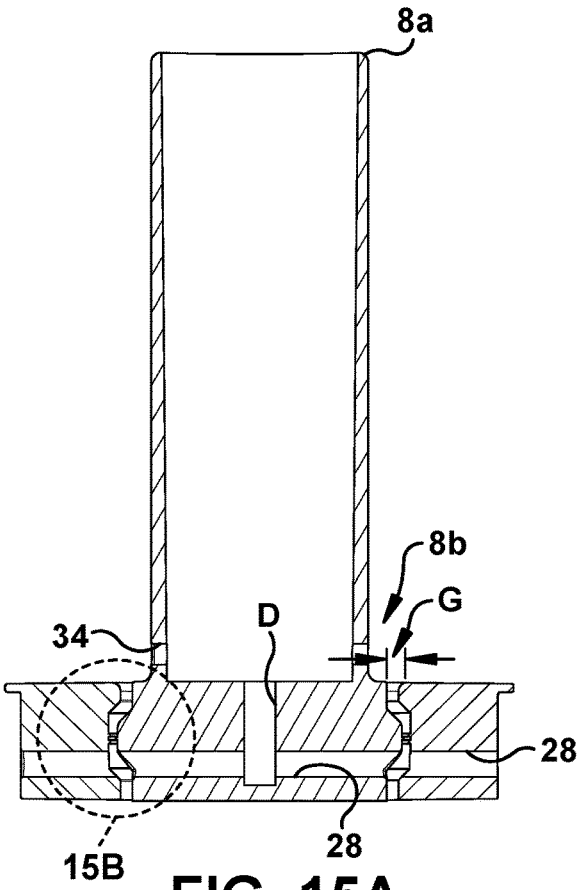
FIG. 15A is a cutaway view of the partially assembled inner tube and clamping assembly components, showing a cross-section taken along the line 15A-15A of FIG. 15.
Figure 15B:
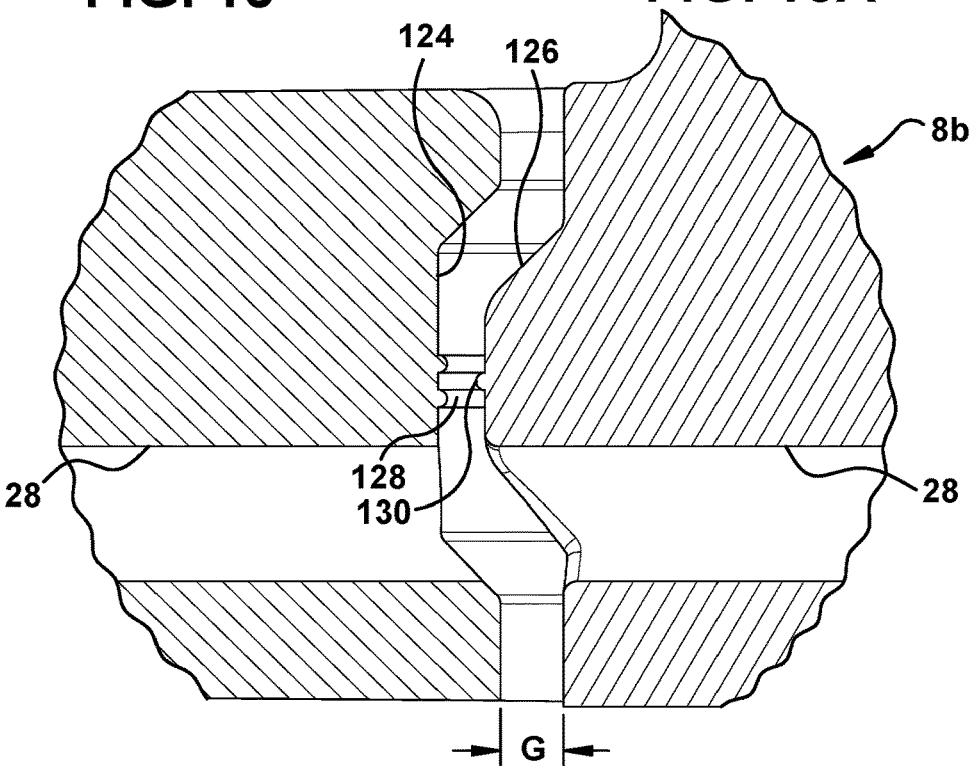
FIG. 15B is a partial enlarged view of the portion of the partially assembled inner tube and clamping assembly components indicated at reference 15B in FIG. 15A.
Figure 22:
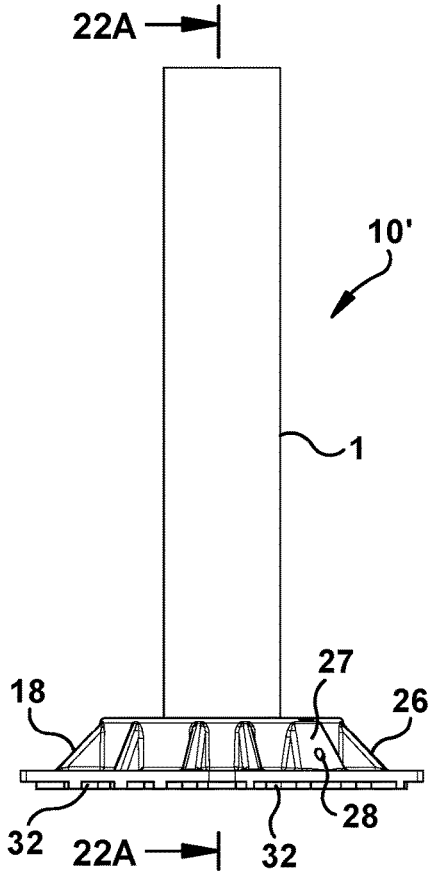
FIG. 22 is a plan view of a corner of the traffic controller marker of FIG. 16.
Figure 22A:
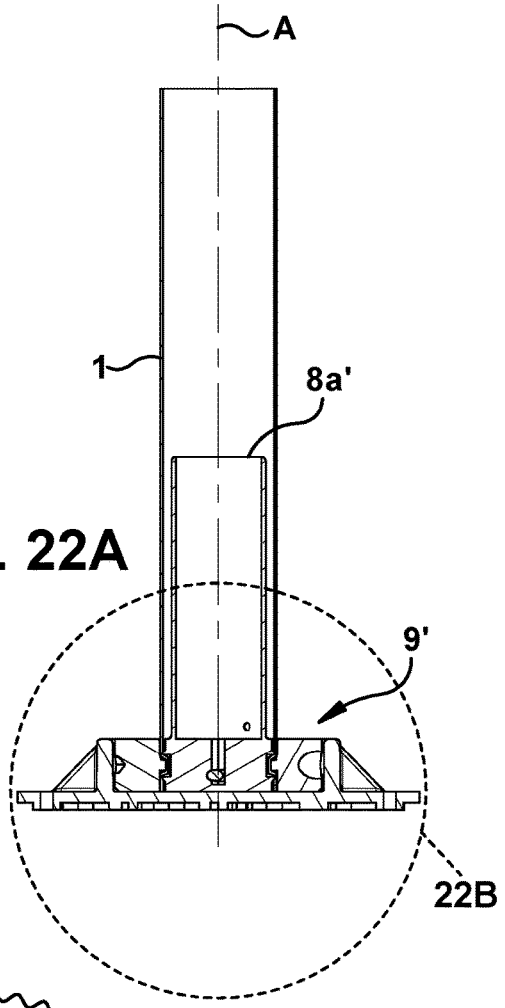
FIG. 22A is a cutaway view showing a cross-section taken along the line 22A-22A of FIG. 22.
Figure 22B:
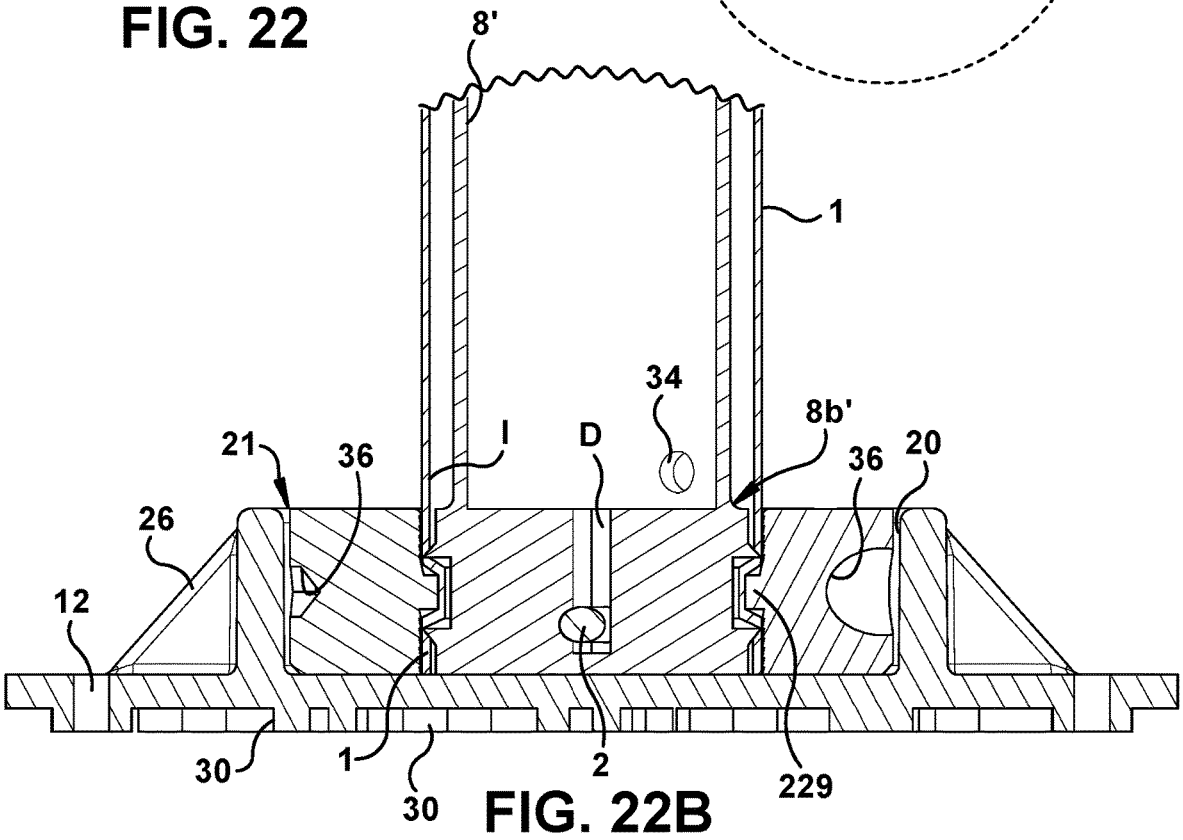
FIG. 22B is a partial enlarged view of the cross-sectional portion indicated at reference 22B in FIG. 22A.
Figure 23:
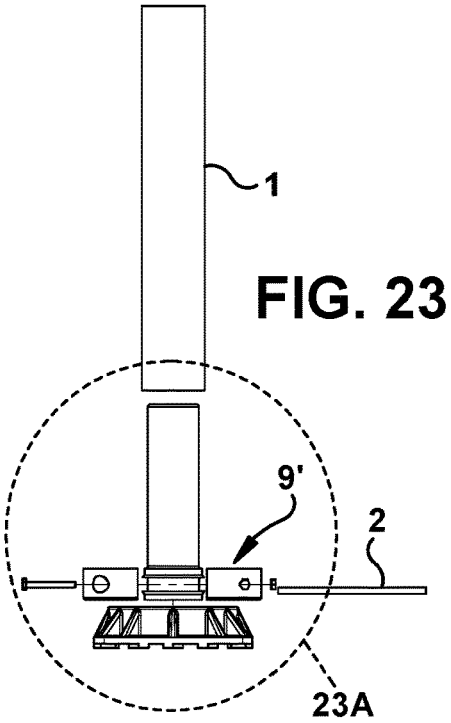
FIG. 23 is a front exploded view of the traffic control marker of FIG. 16.
Figure 23A:
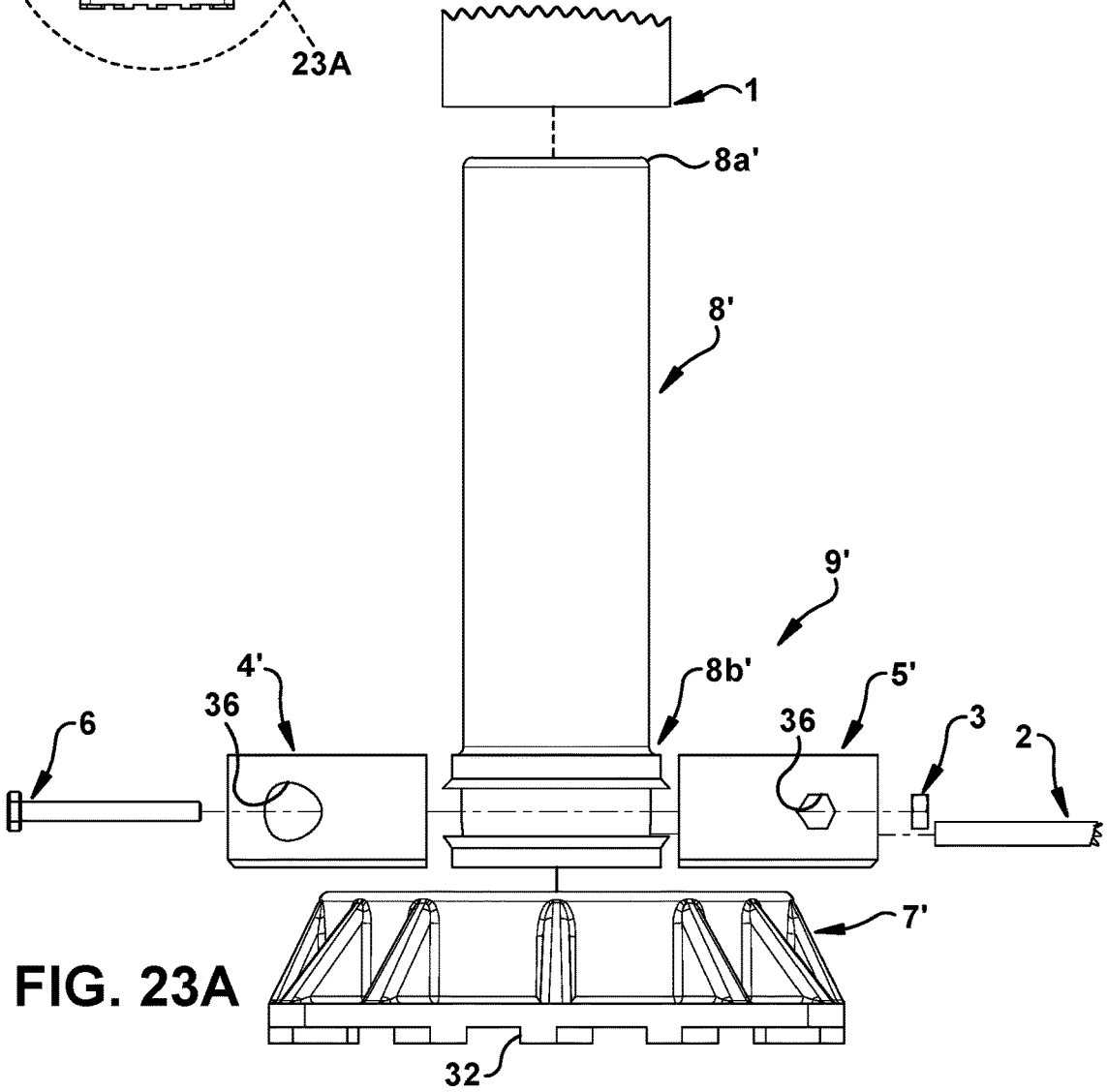
FIG. 23A is a partial enlarged exploded view of the portion indicated at reference 23A in FIG. 23.
Figure 24:
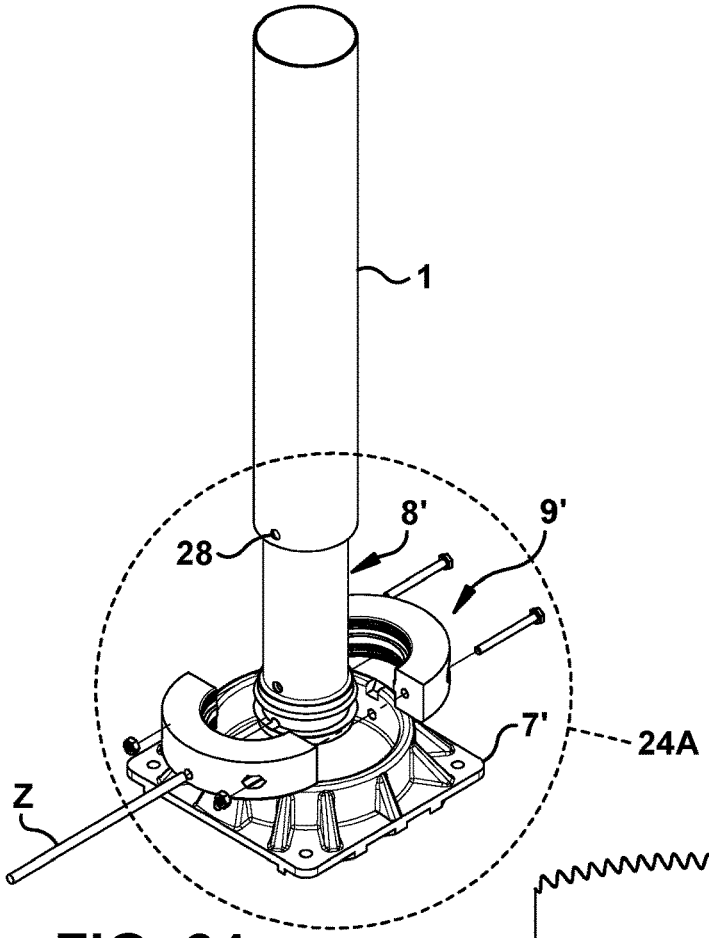
FIG. 24 is a left side perspective exploded view of the traffic control marker of FIG. 16.
Figure 24A:
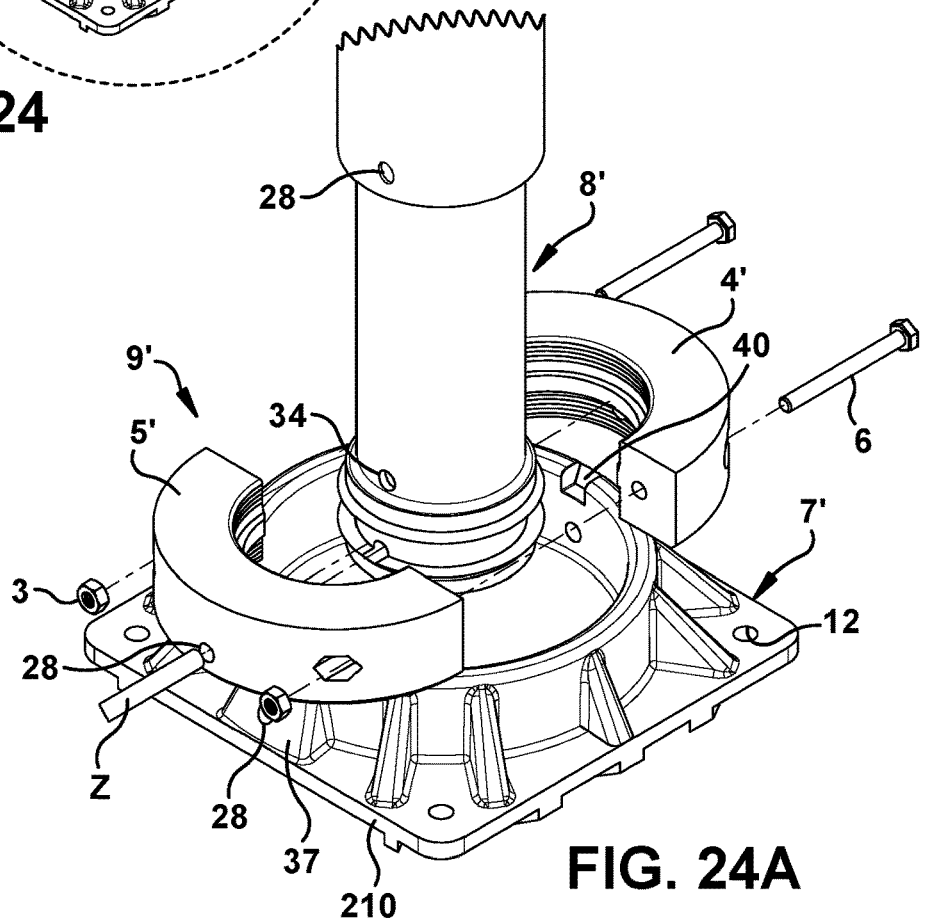
FIG. 24A is a partial enlarged exploded view of the portion indicated at reference 24A in FIG. 24.
Figure 29:
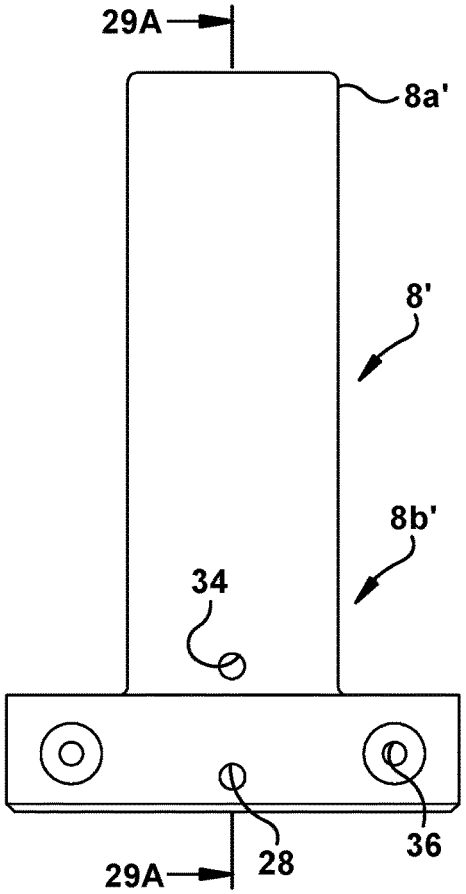
FIG. 29 is a partially assembled right side view of the inner tube and clamping assembly components of the traffic control marker, along the lines shown in FIG. 25.
Figure 29A:
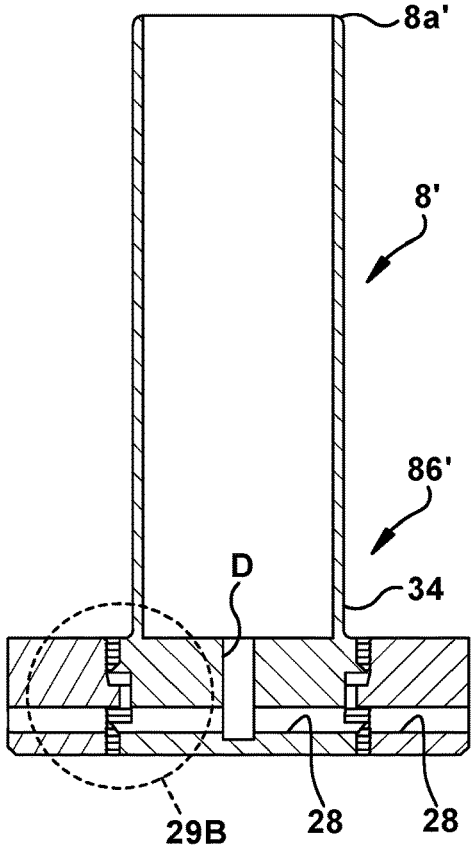
FIG. 29A is a cutaway view of the partially assembled inner tube and clamping assembly components, showing a cross-section taken along the line 29A-29A of FIG. 29.
Figure 29B:
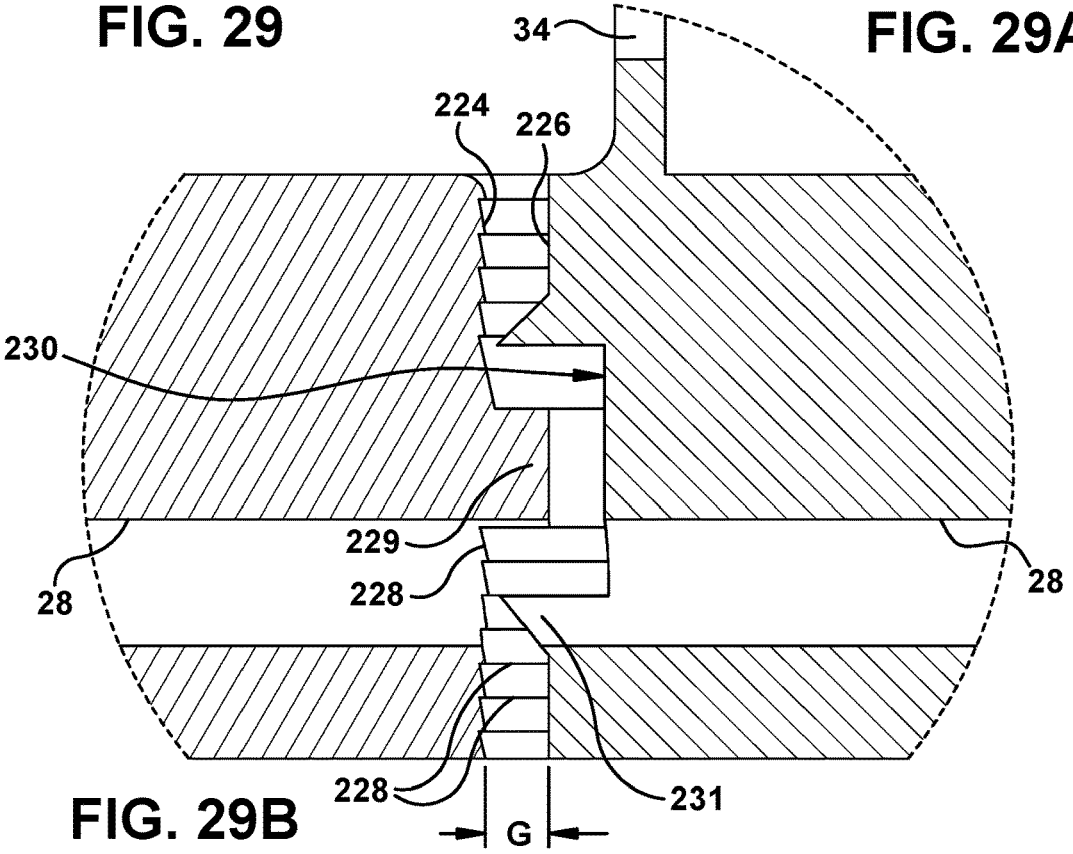
FIG. 29B is a partial enlarged view of the portion of the partially assembled inner tube and clamping assembly components indicated at reference 29B in FIG. 29A.

The clamping assembly 9 is formed by 2 semi-circular and mating clamp members 4, 5, 4', 5' formed of any appropriate material, such as ABS hard plastic or other hard very dense polymer material. An inner clamping surface 124, 224 on each of the clamp members 4, 5, 4', 5' is positioned for clamping the outer tube 1 engaged between an outer base surface 126, 226 formed on the inner tube 8, 8', as shown in FIGS. 8A and 22B. As shown in FIGS. 15B and 29B, a gap G is provided for the outer tube 1 between the inner clamping surface 124, 224 and the outer base surface 126, 226 of the clamping assembly. Alignment tabs 38 are provided on an external surface of each clamp member 4, 5, 4', 5', for engagement within alignment openings 40 within the top surface 18 of the base 7, 7' adjacent the support cavity opening 21.

The outer and inner tubes 1, 8, 8' are likewise of any appropriately flexible material. For example, the outer tube 1 is a straight sided hollow tube of a very flexible rubber or synthetic rubber material, such as a urethane, that will conform around the inner tube as shown in FIGS. 8A and 22B. The inner tube 8, 8' is likewise of a flexible material such as moldable flexible rubber, synthetic rubber, or for example, urethane. The inner tube has a top edge portion with a rounded top surface 8*a*, a straight sided hollow configuration, and a base portion 8*b* having the outer base surface 126, 226. Drainage holes 34 are provided in the straight sided hollow configured portion of the inner tube at a location spaced above the base portion 8*b*. The rounded top surface 8*a* is provided to ensure that upon a vehicle impact to the traffic vehicle marker 10, the top surface of the inner tube does not cut or break the outer tube 1 where the top surface of the inner tube 8, 8' engages the outer tube. Use of a rounded top surface 8*a* ensures there are no sharp edges or right angles of any kind where a cut or break might be caused to the outer tube 1 during a vehicle or other impact. When the semi-circular clamp members 4, 5, 4', 5' are engaged together surrounding the outer and inner tube, they form a clamping ring engaged within the support cavity 20 as shown in FIGS. 8, 8A, 22A and 22B.

Once the outer tube 1 is engaged over the inner tube 8, the clamp members 4, 5, 4', 5' engage the outer tube 1, surrounding the base portion 8*b* of the inner tube 8, 8' as shown, the components may next be secured together. With the circular tubes 1, 8, 8' captured within the clamping assembly 9, the tubes and clamping assembly 9 are tightly secured together in clamped engagement by conventional fasteners (bolts and nuts, for example) 3, 6, engaged through aligned fastener openings 36 formed in and through the clamp members 4, 5, 4', 5', as in FIGS. 9 to 11A, and FIGS. 23 to 25A.

Figure 11:
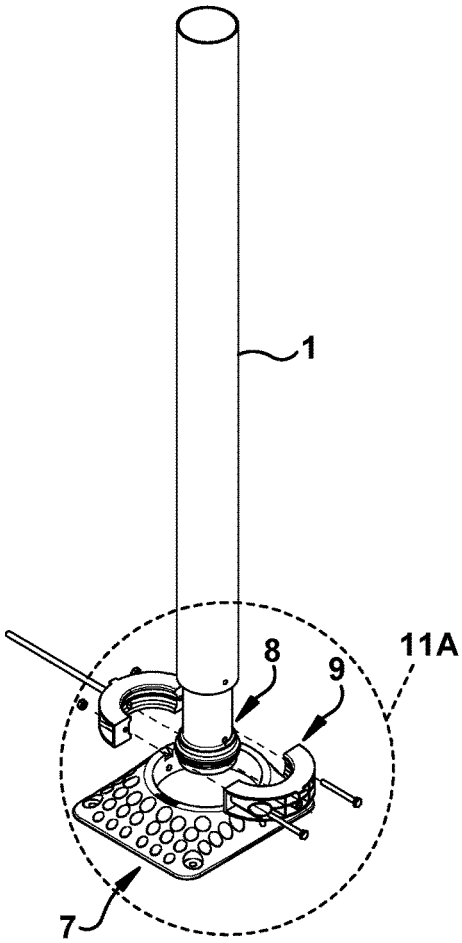
FIG. 11 is a right side perspective exploded view of the traffic control marker of FIG. 1.
Figure 11A:
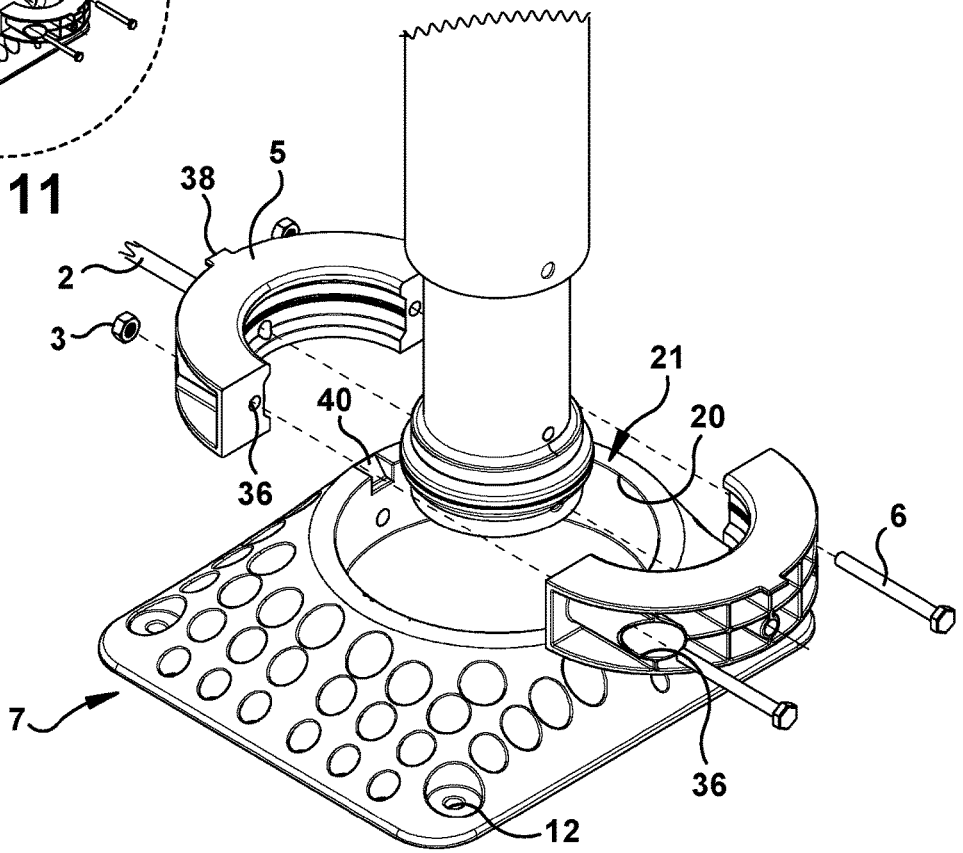
FIG. 11A is a partial enlarged exploded view of the portion indicated at reference 11A in FIG. 11.
Figure 25:
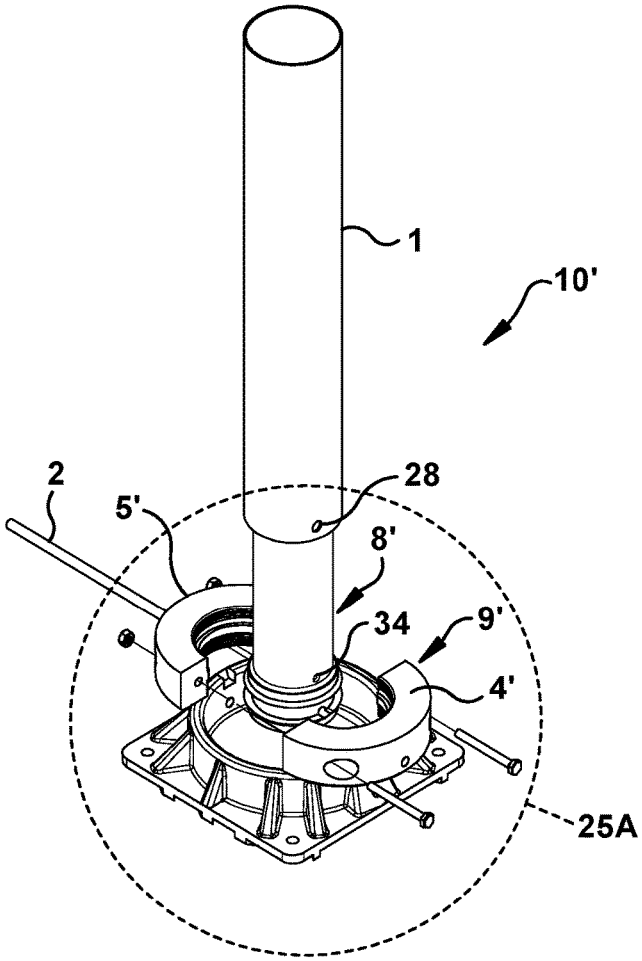
FIG. 25 is a right side perspective exploded view of the traffic control marker of FIG. 16.
Figure 25A:
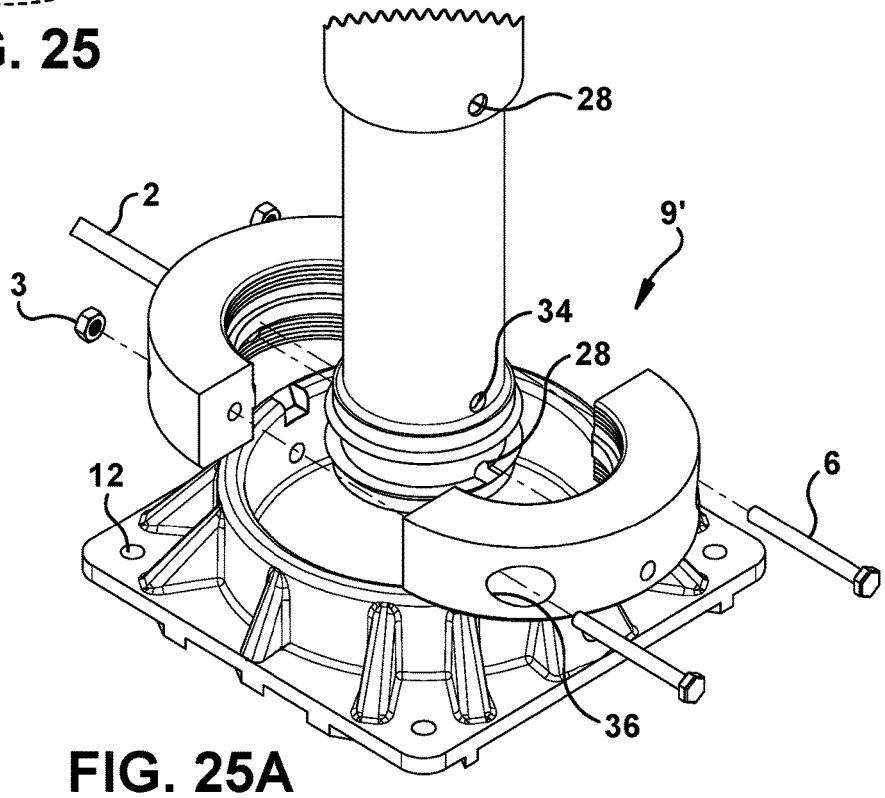
FIG. 25A is a partial enlarged exploded view of the portion indicated at reference 25A in FIG. 25.

Next, the clamped tubes and clamping assembly 9 are engaged within the support cavity 20 of the base 7, 7'. To secure the tubes and clamping assembly within the base 7, 7', a metallic or plastic pin 2, approximately 9 inches in length, or of a length to remain substantially housed within a locking pin hole 28. The locking pin hole 28 is formed transverse to the central axis A of the circular tubes, and through each of the base portion 8*b*, 8*b'* of the inner tube 8, 8', the clamp members 4, 5, 4', 5' and the base 7, 7'. Once the tubes and clamping assembly are positioned within the support cavity 20, and the pin 2 is engaged into the aligned locking pin hole 28, as shown in FIGS. 8A and 22B. In the embodiment of FIGS. 23 to 25A, it is noted that the reinforced support ribs 27 are provided on opposite sides of the base 7' at the location where the pin 2 engages through the base 7'. Additionally, the location of the aligned locking pin hole 28 through the clamp members is below the location where the aligned fastener openings 36 pass through the clamp members, or in a direction toward the perimeter of the base 7, 7', as shown in FIGS. 11A and 25A. By positioning the location of the pin hole 28 lower than the location of clamped engagement by the conventional fasteners 3, 6, or the holding point or point of stress, the risk of breakage or fracture upon vehicle impact is reduced. With the tubes 1, 8, 8' secured within the clamping assembly 9 and base 7, 7', initial vehicle impacts to the traffic control marker enable flexing of the inner and outer tubes, and the flexible return of the tubes to their upright position, as in FIGS. 1 and 16. Again, the rounded top surface 8*a* on the inner tube resists cutting or damage to the outer tube upon vehicle impact.

As shown in FIGS. 8A and 22B, for example, a central drainage opening D with a central axis aligned with the central axis A of the telescoping tubes, is provided within the base portion 8*b* of the inner tube 8, 8'. The central drainage opening D shown has a rectangular configuration, and extends into and past the locking pin hole 28 formed through the base portion 8*b* of the inner tube 8, 8'. The central drainage opening D or weep hole enables any moisture entering the outer tube 1 or the inner tube 8, 8' to pass through drainage holes 34, then down into the central drainage opening D, and eventually to pass over the pin 2 and through the transverse locking pin hole 28 to exit the base 7, 7'. By providing an internal drainage passage or path by the drainage holes 34 formed through the inner tube, any liquid within the inner tube or between the outer and inner tubes, drains along the internal drainage path through the inner tube drain holes, to the central drainage hole, and through the locking pin hole to exit the base. The internal drainage path, removes liquid from inside the inner and outer tubes without the use of a drain hole in the outer tube, since any drain holes or openings in the outer tube 1 may cause breakage or fracture points upon vehicle impact, particularly when the holes or openings are above the holding or clamping point or point of stress.

As provided in FIGS. 13 to 15B of the one embodiment of the traffic control marker 10, the inner clamping surface 124 of the clamp members 4, 5 of the clamping assembly 9, are provided with internal grooves 128. The outer base surface 126 of the base portion 8*b* of the inner tube 8 is provided with a mating ring 130. Once the outer tube 1, is engaged over the base portion 8*b*, and the clamp members 4, 5 surround the outer tube, the outer tube is compressed by the tightening of the conventional fasteners, between the internal grooves 128 and the mating ring 130, as shown in FIG. 8A, to capture the outer tube within the clamping assembly and resist removal upon vehicle impact.

As provided in FIGS. 22B, and 28 to 29B of the second embodiment of the traffic control marker, the inner clamping surface 224 of the clamp members 4', 5' of the clamping assembly are provided with sharp ridges 228, and an extending block 229 with sharp or right angle corners. The outer base surface 226 of the base portion 8*b'* of the inner tube 8' is provided with an inner groove 230, for receiving the extending block 229, and upper and lower sharp wedges 231 extending outwardly away from the base portion 8*b'* from positions above and below the inner groove 230, as in FIG. 28, 28A. Once the outer tube 1, is engaged over the base portion 8*b'*, and the clamp members 4', 5' surround the outer tube, the outer tube is compressed by the tightening of the conventional fasters, such that the sharp ridges 228 and sharp corners of the extending block 229, and the sharp wedges 231, both dig into or engage the outer and inner surfaces of the outer tube 1, as shown in FIG. 22B, to grip the outer tube and resist any slippage or removal from the inner tube 7'.

The conventional fasteners used to clamp the tubes within the clamping assembly may be tightened or loosened to a desired level of compression to obtain the desired result following a critical vehicle impact. After numerous vehicle impacts (preferably in excess of approximately 80, but with the traffic control marker of the second embodiment at least 200 impacts at 70 miles per hour), a "critical" or final vehicle impact to the outer tube may result in the outer or inner tube breaking away from the clamping assembly. While such a final impact may result in the tubes breaking away from clamping assembly and/or the base, the base may not be removed, or pulled away, from the roadway. With the base secured to the roadway, any damaged tubes or components of the clamping assembly may be removed and replaced, without the need to replace or reattach the base to the roadway.

While the present traffic control marker has been shown and described in accordance with several preferred and practical embodiments, it is recognized that departures from the instant disclosure are contemplated within the spirit and scope of the present invention.

We claim:

1. A traffic control marker comprising:

a base;

a support cavity formed within the base, and locking aligned pin holes formed through the support cavity;

an outer flexible hollow tube having locking aligned pin holes, the outer flexible tube covering and supported on an inner flexible tube, the inner flexible tube having a hollow tube portion and a base portion with a bottom, a central drainage hole, a side drainage hole through the hollow tube portion positioned above the base portion, a locking aligned pin hole, and an external surface for engaging a clamping assembly;

a clamping assembly having first and second clamp members, each having a locking aligned pin hole, where the first and second clamp members are clamped in mating engagement with the outer flexible tube engaged over the external surface of the base portion of the inner flexible tube by conventional fasteners engaged through the clamp members at a location above the locking aligned pin holes; and a pin for engagement within the locking aligned pin holes through the clamp members of the clamping assembly, the outer flexible tube, the inner flexible tube and the support cavity within the base, to secure the outer flexible tube and inner flexible tube and clamping assembly within the support cavity of the base.

2. The traffic control marker of claim 1, wherein the base has an external top surface free of any sharp edges or right angle corners.

3. The traffic control marker of claim 1, wherein an internal drainage path is provided between the outer flexible tube and the inner flexible tube, via the side drainage hole, central drainage hole, and aligned locking pin holes through the clamping members and support cavity to exit the base.

4. The traffic control marker of claim 1, wherein the hollow tube portion of the inner flexible tube has a rounded top edge surface.

5. The traffic control marker of claim 1, wherein the base has an external bottom surface having at least one inset grooved channel formed into the external bottom surface, and the ends of the inset grooved channel open at an edge of the external bottom surface of the base.

6. The traffic control marker of claim 1, wherein the first and second clamp members of the clamping assembly have a semi-circular configuration, and in clamped mating engagement form a clamping ring surrounding the outer flexible tube engaged over the external surface of the base portion of the inner flexible tube.

7. The traffic control marker of claim 2, wherein the base has supporting ribs with rounded edges extending upwardly from the external top surface toward an opening to the support cavity, and the locking aligned pin holes formed through the support cavity of the base are provided through reinforced supporting ribs.

8. The traffic control marker of claim 1, wherein the outer flexible tube and the inner flexible tube resist breakage from the base until after at least 200 impacts by a vehicle traveling 70 miles per hour.

9. A base for a traffic control marker having a top surface, a bottom surface and a support cavity having an opening formed in the top surface, and the bottom surface includes an inset grooved channel formed in the shape of a zigzag pattern, and the ends of the inset grooved channel open at an edge of the bottom surface of the base.

10. The base for a traffic control marker of claim 7, wherein support ribs having rounded edges extend upwardly from the top surface.

11. A flexible traffic control marker comprising:

a base having an external top surface with only rounded edges and free of any sharp corners;

a support cavity formed within the base, and locking aligned pin holes formed through the support cavity;

an outer flexible hollow tube having locking aligned pin holes, the outer flexible tube covering and supported on an inner flexible tube, the inner flexible tube having a hollow tube portion with a rounded top edge surface, and a base portion with a bottom, a central drainage hole, a side drainage hole through the hollow tube portion positioned above the base portion, a locking aligned pin hole, and an external surface for engaging a clamping assembly;

a clamping assembly having first and second clamp members, each with a semi-circular configuration, each having a locking aligned pin hole, where the first and second clamp members are clamped in mating engagement with the outer flexible tube engaged over the external surface of the base portion of the inner flexible tube by conventional fasteners engaged through the clamp members at a location above the locking aligned pin holes; and a pin for engagement within the locking aligned pin holes through the clamp members of the clamping assembly, the outer flexible tube, the inner flexible tube and the support cavity within the base, to secure the outer flexible tube and inner flexible tube and clamping assembly within the support cavity of the base.

12. The flexible traffic control marker of claim 11, wherein the semi-circular first and second clamp members of the clamping assembly in clamped mating engagement form a clamping ring surrounding the outer flexible tube engaged over the external surface of the base portion of the inner flexible tube, and an interior surface of the first and second clamp members includes sharp ridges and an extending block with sharp corners for engagement with the outer flexible tube, and the external surface of the base portion of the inner flexible tube includes in inner groove positioned to align with the extending block, and sharp wedges positioned at the top and bottom of the inner groove for engagement with an internal surface of the outer flexible tube, when clamp members are secured in clamped and mating engagement, the outer flexible tube and inner flexible tube resist removal from the support cavity of the base.

13. The traffic control marker of claim 12, wherein the base has an external bottom surface having at least one inset grooved channel formed into the external bottom surface, and the ends of the inset grooved channel open at an edge of the external bottom surface of the base.

14. The traffic control marker of claim 13, wherein the shape of the inset groove channel is a zigzag pattern.

15. The traffic control marker of claim 12, wherein the first and second clamp members of the clamping assembly have a semi-circular configuration, and in clamped mating engagement form a clamping ring surrounding the outer flexible tube engaged over the external surface of the base portion of the inner flexible tube.

16. The traffic control marker of claim 12, wherein the base has supporting ribs with rounded edges extending upwardly from the external top surface toward an opening to the support cavity, and the locking aligned pin holes formed through the support cavity of the base are provided through reinforced supporting ribs.

17. The traffic control marker of claim 12, wherein the outer flexible tube and the inner flexible tube resist breakage away from the base until after at least 200 impacts by a vehicle traveling 70 miles per hour.

* * * * *